US008129309B2

(12) United States Patent
Yokozawa et al.

(10) Patent No.: US 8,129,309 B2
(45) Date of Patent: Mar. 6, 2012

(54) HEAT-SENSITIVE TRANSFER SHEET FOR USE IN HEAT-SENSITIVE TRANSFER SYSTEM AND IMAGE-FORMING METHOD USING HEAT-SENSITIVE TRANSFER SYSTEM

(75) Inventors: Akito Yokozawa, Minami-ashigara (JP); Kazuaki Oguma, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 976 days.

(21) Appl. No.: 12/058,573

(22) Filed: Mar. 28, 2008

(65) Prior Publication Data

US 2008/0274880 A1 Nov. 6, 2008

(30) Foreign Application Priority Data

Mar. 29, 2007 (JP) ..... 2007-088756

(51) Int. Cl.
*B41M 5/035* (2006.01)
*B41M 5/382* (2006.01)

(52) U.S. Cl. ..... 503/227; 8/471

(58) Field of Classification Search ..... None
See application file for complete search history.

(56) References Cited

U.S. PATENT DOCUMENTS 6,372,689 B1 4/2002 Kuga et al.
6,946,424 B2 * 9/2005 Ieshige et al. ..... 503/227

FOREIGN PATENT DOCUMENTS

| | | | |
|---|---|---|---|
| JP | 63-151484 | A | 6/1988 |
| JP | 03-101995 | A | 4/1991 |
| JP | 4-148990 | | 5/1992 |
| JP | 04-255394 | A | 9/1992 |
| JP | 6-286335 | | 10/1994 |
| JP | 06-316171 | A | 11/1994 |
| JP | 10-244764 | A | 9/1998 |

* cited by examiner

*Primary Examiner* — Bruce H Hess
(74) *Attorney, Agent, or Firm* — Sughrue Mion, PLLC

(57) ABSTRACT

A heat-sensitive transfer sheet, comprising a base film, at least three heat-sensitive transfer layers containing heat-sensitively transferable dyes and a resin, and a heat-resistant slipping layer, in which the at least three heat-sensitive transfer layers contains two or more dyes different from each other; the heat-sensitive transfer layers are provided on one face of the base film so as not to be superposed on one another; the heat-sensitive transfer layers contains, as the resin, at least one of a polyvinylbutyral resin and a polyvinyl acetacetal resin, each having a polymerization degree of 200 to 1,000; and at least one of the heat-sensitive transfer layers contains the polyvinylbutyral resin as described above and the polyvinyl acetacetal resin described above, and has a ratio of the polyvinylbutyral to the polyvinyl acetacetal different from those in the other heat-sensitive transfer layers.

8 Claims, 1 Drawing Sheet

HEAT-SENSITIVE TRANSFER SHEET FOR USE IN HEAT-SENSITIVE TRANSFER SYSTEM AND IMAGE-FORMING METHOD USING HEAT-SENSITIVE TRANSFER SYSTEM

FIELD OF THE INVENTION

The present invention relates to a heat-sensitive transfer sheet that gives a high-density and high-quality image and is compatible with high-speed printing. In addition, the present invention relates to an image-forming method using heat-sensitive transfer system.

BACKGROUND OF THE INVENTION

Various heat transfer recording methods have been known so far. Among these methods, dye diffusion transfer recording systems attract attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver halide photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

Recently, various printers allowing higher-speed printing have been developed and commercialized increasingly in the field of the dye-diffusion transfer recording systems. The high-speed printing is a performance desirable for shortening the time of the user waiting for printing in photo shop.

For high-speed printing, it is needed to make the dye transferred from heat-sensitive transfer layers of the heat-sensitive transfer sheet in a shorter time, but it also leads to deterioration of storage properties of the heat-sensitive transfer sheet at the same time. Accordingly, it is necessary to raise the transfer density without deterioration of the storage properties of the heat-sensitive transfer sheet. From the viewpoint, known are methods of using multiple dyes and multiple binders in the heat-sensitive transfer layer (e.g., JP-A-4-148990 ("JP-A" means unexamined published Japanese patent application) and JP-A-6-286335).

Further intensive studies with the methods above along with the need for further higher-speed printing revealed that it was indeed possible to raise the maximum density by the methods, but also that the methods raised a new problem that the balance of colors in the image, yellow, magenta and cyan, in a region lower in density was significantly degraded. The color balance in print image, especially in neutral-colored gray image (e.g., cloud in cloudy sky) or in female portrait image, should be kept favorably. It may be effective, to solve the problem, to change the heat quantity of the thermal head and thus change the amount of the transferred dyes to a desirable density by modifying the lookup table for adjustment of the electric signal. However, the method unfavorably demands correction of the lookup tables in all printers the users are already using.

SUMMARY OF THE INVENTION

The present invention resides in a heat-sensitive transfer sheet, comprising a base film, at least three heat-sensitive transfer layers containing heat-sensitively transferable dyes and a resin formed on one face of the base film, and a heat-resistant slipping layer formed on the other face of the base film, wherein each of the at least three heat-sensitive transfer layers contains two or more kinds of dyes different from each other, wherein the at least three heat-sensitive transfer layers are provided on one face of the base film so as not to be superposed on one another, wherein the at least three heat-sensitive transfer layers contain, as the resin, at least one selected from the group consisting of a polyvinylbutyral resin having a polymerization degree of 200 to 1,000 and a polyvinyl acetacetal resin having a polymerization degree of 200 to 1,000, and wherein at least one of the at least three heat-sensitive transfer layers contains the polyvinylbutyral resin as described above and the polyvinyl acetacetal resin described above, and has a ratio of the polyvinylbutyral to the polyvinyl acetacetal different from those in the other heat-sensitive transfer layers.

Further, the present invention resides in an image-forming method, comprising the steps of:

superposing a heat-sensitive transfer sheet on a heat-sensitive transfer image-receiving sheet; and providing thermal energy from a side of a heat-resistant slipping layer as described below of the heat-sensitive transfer sheet with a thermal head, thereby to transfer dyes contained in heat-sensitive transfer layers as described below of the heat-sensitive transfer sheet onto the heat-sensitive transfer image-receiving sheet, and to print an image;

wherein the heat-sensitive transfer sheet comprises a base film, at least three heat-sensitive transfer layers containing heat-sensitively transferable dyes and a resin formed on one face of the base film, and the heat-resistant slipping layer formed on the other face of the base film, wherein each of the at least three heat-sensitive transfer layers contains two or more kinds of dyes different from each other, wherein the at least three heat-sensitive transfer layers are provided on one face of the base film so as not to be superposed on one another, wherein the at least three heat-sensitive transfer layers contains, as the resin, at least one selected from the group consisting of a polyvinylbutyral resin having a polymerization degree of 200 to 1,000 and a polyvinyl acetacetal resin having a polymerization degree of 200 to 1,000, wherein at least one of the at least three heat-sensitive transfer layers contains the polyvinylbutyral resin as described above and the polyvinyl acetacetal resin described above, and has a ratio of the polyvinylbutyral to the polyvinyl acetacetal different from those in the other heat-sensitive transfer layers, and wherein each of the heat-sensitive transfer layers is printed with the thermal head at a speed of 100 mm/second or more.

Other and further features and advantages of the invention will appear more fully from the following description, appropriately referring to the accompanying drawings.

DETAILED DESCRIPTION OF THE INVENTION

Figure 1:
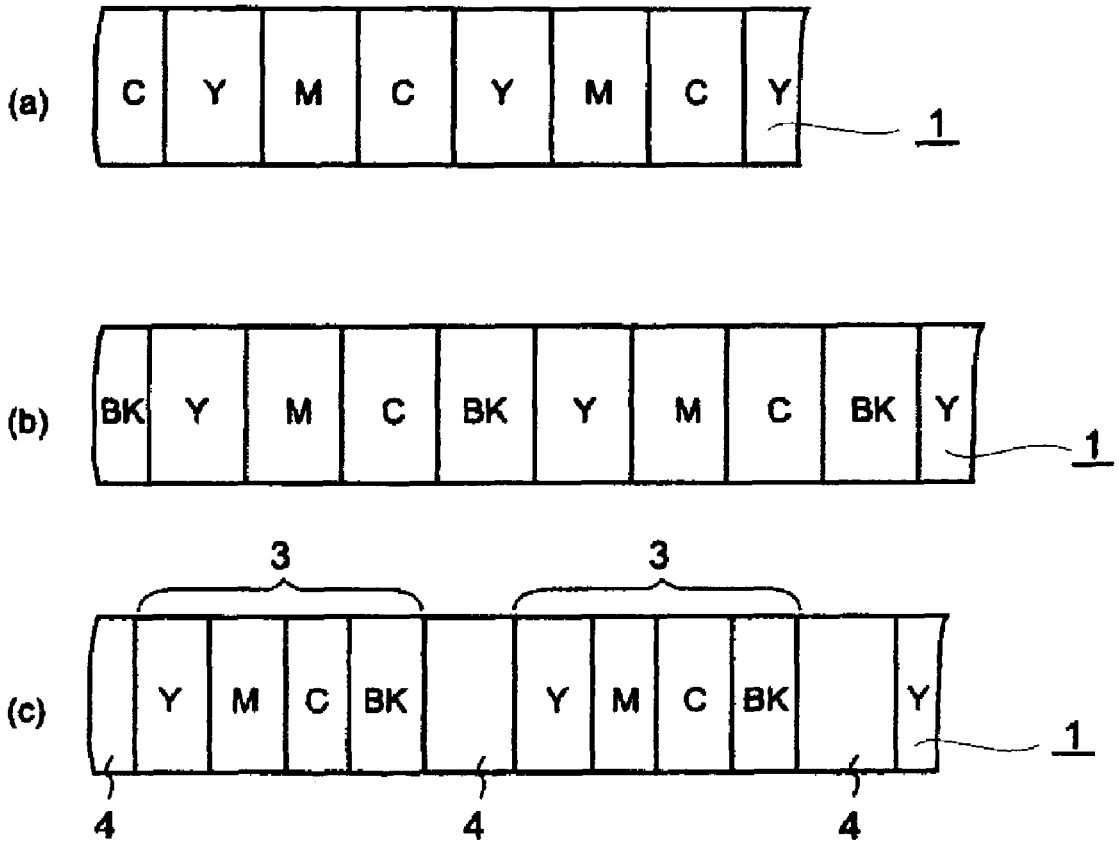
FIG. 1(*a*) to FIG. 1(*c*) each are a plan view showing one embodiment of the heat-sensitive transfer ink sheet.

The present invention provides the following means.

(1) A heat-sensitive transfer sheet, comprising a base film, at least three heat-sensitive transfer layers containing heat-sensitively transferable dyes and a resin formed on one face of the base film, and a heat-resistant slipping layer formed on the other face of the base film, wherein each of the at least three heat-sensitive transfer layers contains two or more kinds of dyes different from each other, wherein the at least three heat-sensitive transfer layers are provided on one face of the base film so as not to be superposed on one another, wherein the at least three heat-sensitive transfer layers contain, as the resin, at least one selected from the group consisting of a polyvinylbutyral resin having a polymerization degree of 200 to 1,000 and a polyvinyl acetacetal resin having a polymerization degree of 200 to 1,000, and wherein at least one of the at least three heat-sensitive transfer layers contains the polyvinylbutyral resin as described above and the polyvinyl acetacetal resin described above, and has a ratio of the polyvinylbutyral to the polyvinyl acetacetal different from those in the other heat-sensitive transfer layers.

(2) The heat-sensitive transfer sheet described in the above item (1), wherein content of each of the two or more kinds of dyes (mass %) is 90 mass % or less with respect to the total amount of dyes in each of the heat-sensitive transfer layers.

(3) The heat-sensitive transfer sheet described in the above item (1) or (2), wherein the at least three heat-sensitive transfer layers include a heat-sensitive transfer layer allowing transfer of yellow image, a heat-sensitive transfer layer allowing transfer of magenta image, and a heat-sensitive transfer layer allowing transfer of cyan image.

(4) An image-forming method, comprising the steps of:

superposing a heat-sensitive transfer sheet on a heat-sensitive transfer image-receiving sheet; and providing thermal energy from a side of a heat-resistant slipping layer as described below of the heat-sensitive transfer sheet with a thermal head, thereby to transfer dyes contained in heat-sensitive transfer layers as described below of the heat-sensitive transfer sheet onto the heat-sensitive transfer image-receiving sheet, and to print an image;

wherein the heat-sensitive transfer sheet comprises a base film, at least three heat-sensitive transfer layers containing heat-sensitively transferable dyes and a resin formed on one face of the base film, and the heat-resistant slipping layer formed on the other face of the base film, wherein each of the at least three heat-sensitive transfer layers contains two or more kinds of dyes different from each other, wherein the at least three heat-sensitive transfer layers are provided on one face of the base film so as not to be superposed on one another, wherein the at least three heat-sensitive transfer layers contain, as the resin, at least one selected from the group consisting of a polyvinylbutyral resin having a polymerization degree of 200 to 1,000 and a polyvinyl acetacetal resin having a polymerization degree of 200 to 1,000, wherein at least one of the at least three heat-sensitive transfer layers contains the polyvinylbutyral resin as described above and the polyvinyl acetacetal resin described above, and has a ratio of the polyvinylbutyral to the polyvinyl acetacetal different from those in the other heat-sensitive transfer layers, and wherein each of the heat-sensitive transfer layers is printed with the thermal head at a speed of 100 mm/second or more.

(5) The image-forming method as described in the above item (4), wherein content of each of the two or more kinds of dyes (mass %) is 90 mass % or less with respect to the total amount of dyes in each of the heat-sensitive transfer layers.

(6) The image-forming method described in the above item (4) or (5), wherein the at least three heat-sensitive transfer layers include a heat-sensitive transfer layer allowing transfer of yellow image, a heat-sensitive transfer layer allowing transfer of magenta image, and a heat-sensitive transfer layer allowing transfer of cyan image.

The present invention will be explained in detail below.

1) Heat-Sensitive Transfer Sheet

The following is an explanation of a heat-sensitive transfer sheet (ink sheet) of the present invention.

The ink sheet is used together with the above-described heat-sensitive transfer image-receiving sheet at the time of a heat-sensitive transfer image formation. The ink sheet is composed of a base film and, disposed thereon, heat-sensitive transfer layers (hereinafter sometimes referred to as dye layers) containing diffusion transfer dyes prepared in the form of dye ink.

The dye ink will be explained in detail below.

(Dye Ink)

The dye ink contains at least sublimation type dyes and a binder resin. It is a preferable embodiment that the dye layers also contain optional materials such as organic or inorganic finely divided powder, waxes, silicone resins, and fluorine-containing organic compounds in accordance with necessity.

In the present invention, a resin selected from a polyvinylbutyral having a polymerization degree of 200 to 1,000 and a polyvinyl acetacetal having a polymerization degree of 200 to 1,000 should be used as the resin in the dye ink layers. If the polymerization degree of the resin is smaller than 200, one surface of the ink sheet may be bound to the rear face thereof when the ink sheet is stored in the rolled form, and thus, such an ink sheet is useless in practice. If the polymerization degree of the resin is larger than 1,000, the maximum density of printed image under high-speed printing condition is lower, and the color balance thereof is also unfavorable. The polymerization degree of the polyvinylbutyral is more preferably in the range of 200 to 950 and most preferably 250 to 900. The polymerization degree of the polyvinyl acetacetal is more preferably in the range of 200 to 950 and most preferably 250 to 900. In addition, at least one of the dye layers contains a polyvinylbutyral having a polymerization degree of 200 to 1,000 and a polyvinyl acetacetal having a polymerization degree of 200 to 1,000 in combination. Further, the at least one dye ink layer is different in the resin component ratio of the polyvinylbutyral to the polyvinyl acetacetal from other dye ink layers. It is possible to satisfy the all requirements in maximum density, ink sheet storage properties and color balance during high-speed print, by satisfying the requirements above and also the requirement of using multiple dyes described below. As for the resin component ratio in the at least one dye ink containing both the polyvinylbutyral and the polyvinyl acetacetal, the content of the polyvinylbutyral is preferably 5 to 95 mass %, most preferably 10 to 50 mass %, and the content of the polyvinyl acetacetal is preferably 5 to 95 mass %, most preferably 50 to 90 mass %, with respect to the total resin mass in the ink. When yellow, magenta and cyan dye inks are used as the dye inks, the ratio of the polyvinylbutyral with respect to the total resin mass in the ink is preferably 10 to 95 mass %, most preferably 20 to 50 mass %, in the yellow dye ink, preferably 0 to 50 mass %, most preferably 5 to 20 mass %, in the magenta dye ink, and preferably 5 to 80 mass %, most preferably 10 to 40 mass %, in the cyan dye ink (a content of 0 mass % means that no polyvinylbutyral and only polyvinyl acetacetal is contained). As for the ratio of the polyvinylbutyral in each dye ink layer, the ratio in the at least one dye ink layer should be different from those in other dye ink layers, and the largest difference in the ratio is preferably 5 mass % or more, most preferably 10 mass % or more.

The term "resin composition ratio" as used in the present invention refers to the mixing ratio between the polyvinyl butyral resin and the polyvinyl acetacetal resin. And the expression of "differing from another thermal transfer layer in resin composition ratio" means having a resin composition ratio different from a resin composition ratio of every other thermal transfer layer.

In the present invention, various known resins may be used in combination with the resins above. Examples of the resins include modified cellulose resins such as ethyl cellulose, hydroxyethyl cellulose, ethyl hydroxycellulose, hydroxypropyl cellulose, ethylhydroxyethyl cellulose, methyl cellulose, cellulose acetate, cellulose acetate butyrate, cellulose acetate propionate, and cellulose nitrate; vinyl resins such as polyvinyl alcohol, polyvinyl acetate, polyvinyl butyrate, polyvinyl acetal, polyvinyl pyrroridone, polystyrene, and polyvinyl chloride; acrylic resins such as polyacrylonitrile, polyacrylate, and polyacrylamide; polyurethane resins, polyamide resins, polyester resins, polycarbonate resins, phenoxy resins, phenol resins, epoxy resins, and various kinds of elastomers. Each of these resins set forth above are preferably used. These resins may be used alone, or mixed together. In the case of polymers, various kinds of resin-constituting monomers may be copolymerized before use. It is also a preferable embodiment to crosslink the polymers with various kinds of crosslinking agents.

In a favorable embodiment, a modified cellulosic resin or a vinyl resin is preferably used, more preferably in combination with a propionic acid-modified cellulose, a polyvinylbutyral outside the scope defined in the present invention, or a polyvinyl acetacetal outside the scope defined in the present invention.

The dyes for use in the present invention is not particularly limited, so far as the dyes are able to diffuse by heat and able to be incorporated in a sublimation type heat-sensitive transfer sheet, and able to transfer by heat from the sublimation type heat-sensitive transfer sheet to an image-receiving sheet. As the dyes that are used for the heat-sensitive transfer sheet, ordinarily used dyes or known dyes can be effectively used.

In the present invention, multiple dyes should be contained in the same dye ink, and it is possible to satisfy the requirements in the maximum density, ink-sheet storage properties and color balance in the low density area at the same time, by satisfying the requirements of resins according to the present invention. As for the ratio of each dye in the dye ink layers, the content of each dye is preferably 95 mass % or less, most preferably 90 mass % or less, with respect to the total dye mass in the ink.

Preferable examples of the dyes that is used in the present invention include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together. For instance, a black hue can be obtained from a combination of dyes.

Dyes that can be preferably used in the present invention are explained in detail below.

In the heat-sensitive transfer layer of the ink sheet that is used in the present invention, use can be made of known dyes that have been used as a yellow dye from the past. Examples of the yellow dye include dyes represented by any one of formulae (Y1) to (Y4) set forth below. However, the yellow dyes that can be used in the present invention are not limited to these dyes.

First, the dye represented by formula (Y1) is explained in detail below.

Formula (Y1)

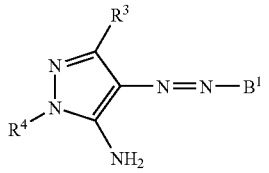

In the formula (Y1), $B^1$ represents a substituted or unsubstituted aryl group or a substituted or unsubstituted aromatic heterocyclic group, $R^3$ represents a substituted or unsubstituted alkyl group, and $R^4$ represents a substituted or unsubstituted alkyl group or a substituted or unsubstituted aryl group.

Each group of $R^3$ and $R^4$ may further have a substituent. Examples of the substituent by which each group of $B^1$, $R^3$ and $R^4$ may be substituted include the same substituents as the ring A and each group of $R^1$ and $R^2$ in the formula (Y3) described below may have.

The aryl group of $B^1$ is preferably a phenyl group which may have a substituent.

Examples of a preferred combination of the substituents $B^1$, $R^3$ and $R^4$ in a dye represented by the formula (Y1) include combinations wherein $B^1$ is a substituted or unsubstituted aryl group having 6 to 10 carbon atoms, a substituted or unsubstituted pyrazolyl group or a substituted or unsubstituted thiadiazolyl group, $R^3$ is a substituted or unsubstituted alkyl group having 1 to 8 carbon atoms, and $R^4$ is a substituted or unsubstituted alkyl group having 1 to 8 carbon atoms or a substituted or unsubstituted aryl group having 6 to 10 carbon atoms.

In more preferred combinations of the substituents, $B^1$ is a substituted or unsubstituted phenyl group or a substituted or unsubstituted 1,3,4-thiadiazolyl group, $R^3$ is a substituted or unsubstituted alkyl group having 1 to 6 carbon atoms, and $R^4$ is a substituted or unsubstituted alkyl group having 1 to 6 carbon atoms or a substituted or unsubstituted phenyl group.

In the most preferred combinations of the substituents, $B^1$ is a 4-nitrophenyl group or a 1,3,4-thiadiazolyl group substituted with a thioalkyl group having 1 to 6 carbon atoms, $R^3$ is an unsubstituted alkyl group having 1 to 4 carbon atoms, and $R^4$ is an unsubstituted alkyl group having 1 to 4 carbon atoms or a substituted or unsubstituted phenyl group. The substituent of the phenyl group of $R^4$ is preferably a 2-chloro group, a 4-chloro group, a 2,4,6-trichloro group, a 4-carboxylmethyl group or a 4-carboxyethyl group.

Hereinafter, specific examples of the dye represented by formula (Y1) will be shown, but the present invention is not limited thereto.

Y1-1

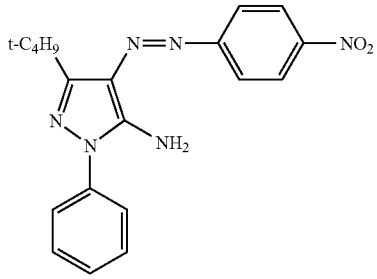

Y1-2

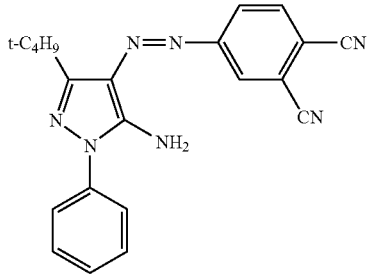

Y1-3

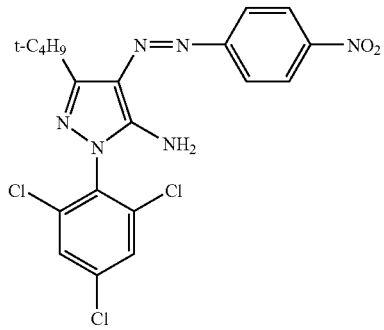

-continued

Y1-4

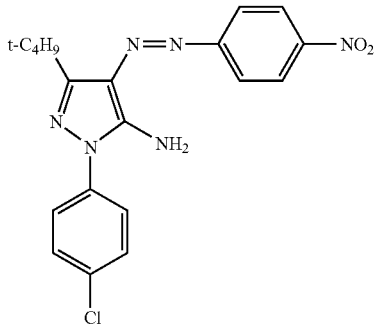

Y1-5

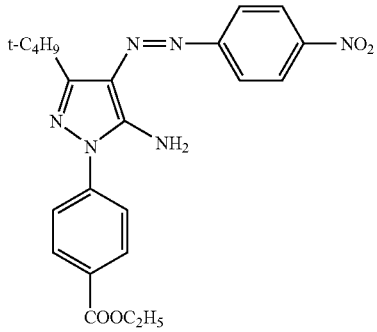

Y1-6

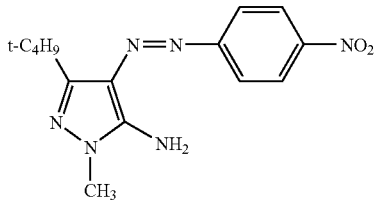

Y1-7

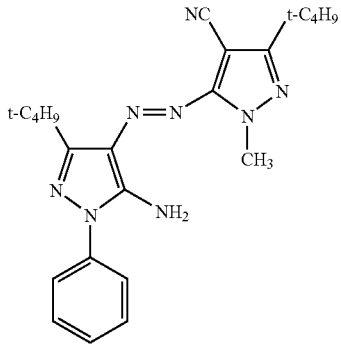

Y1-8

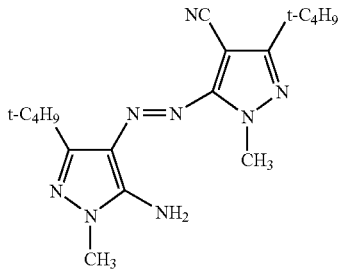

-continued

Y1-9

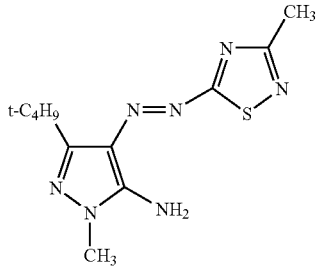

Y1-10

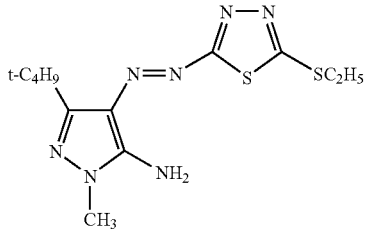

Next, the dye represented by formula (Y2) is explained in detail below.

Formula (Y2)

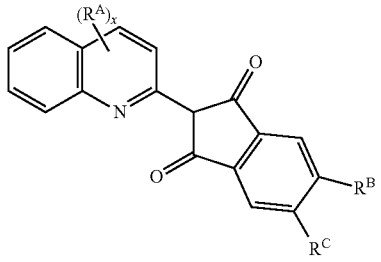

In the formula (Y2), $R^A$ represents a substituent, which is preferably a halogen atom, a hydroxyl group, an alkyl group having 1 to 8 carbon atoms, a cycloalkyl group, an alkoxyl group, an alkoxycarbonyl group, an alkylthio group, an alkylsulfonyl group, an amino group, an alkylamino group, an arylamino group, a sulfonamido group, an aryloxy group or an arylthio group, more preferably an alkyl group having 1 to 8 carbon atoms or a hydroxyl group. x represents an integer of 0 to 6, preferably an integer of 0 to 3, more preferably an integer of 1 to 2. $R^B$ and $R^C$ each independently represent an acyl group, an alkoxycarbonyl group or a carbamoyl group.

When each of the groups recited above has, as its partial structure, an alkyl moiety, an aryl moiety or a heterocyclic moiety, the group may further have a substituent. Examples of such a substituent include the same substituents as the ring A, $R^1$ and $R^2$ in the formula (Y3) described below may have.

Hereinafter, specific examples of the dye represented by formula (Y2) will be shown, but the present invention is not limited thereto.

Y2-1

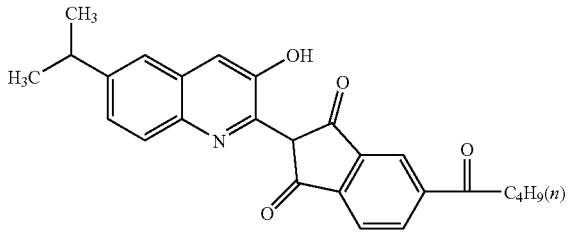

Y2-2

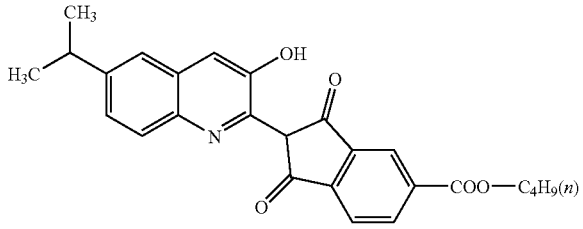

Y2-3

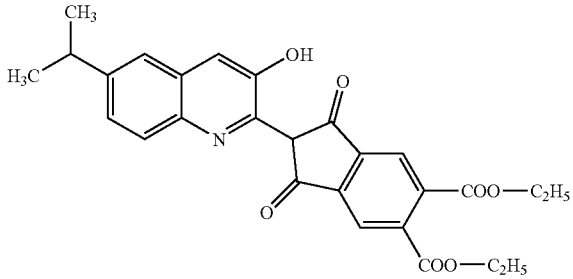

Next, the dye represented by formula (Y3) is explained in detail below.

Formula (Y3)

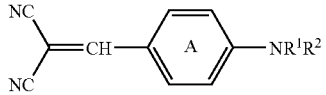

In the formula (Y3), the ring A represents a substituted or unsubstituted benzene ring, and $R^1$ and $R^2$ each independently represent a hydrogen atom, a substituted or unsubstituted alkyl group, a substituted or unsubstituted alkenyl group or a substituted or unsubstituted aryl group.

Each of the groups represented by $R^1$ and $R^2$ may further have a substituent. Examples of a substituent by which the ring A, $R^1$ and $R^2$ each may be substituted include a halogen atom, an unsaturated alkyl group, a cycloalkyl group, an aryl group, a heterocyclic group, an alkoxyl group, an acyloxy group, a carbamoyloxy group, an alkoxycarbonyloxy group, an aryloxycarbonyloxy group, an amino group, an acylamino group, an aminocarbonylamino group, an alkoxycarbonylamino group, a sulfamoylamino group, an alkyl- or arylsulfonylamino group, an alkylthio group, a sulfamoyl group, an alkyl group, an arylsulfinyl group, an arylsulfonyl group, an acyl group, an aryloxycarbonyl group, an alkoxycarbonyl group, a carbamoyl group, an aryl- or heterocyclic azo group, an imido group, a hydroxyl group, a cyano group, a nitro group, a sulfo group and a carboxyl group.

Examples of a preferred combination of the ring A and the substituents $R^1$ and $R^2$ in a dye represented by the formula (Y3) include combinations wherein the ring A is a substituted or unsubstituted benzene ring, $R^1$ is a substituted or unsubstituted alkyl group having 1 to 8 carbon atoms, an allyl group or a substituted or unsubstituted aryl group having 6 to 10 carbon atoms, and $R^2$ is a substituted or unsubstituted alkyl group having 1 to 8 carbon atoms, an allyl group or a substituted or unsubstituted aryl group having 6 to 10 carbon atoms.

In more preferred combinations of the ring A and the substituents $R^1$ and $R^2$, the ring A is a substituted or unsubstituted benzene ring, $R^1$ is a substituted or unsubstituted alkyl group having 1 to 6 carbon atoms, an allyl group or a substituted or unsubstituted phenyl group, and $R^2$ is a substituted or unsubstituted alkyl group having 1 to 6 carbon atoms, an allyl group or a substituted or unsubstituted phenyl group.

In the most preferred combinations, the ring A is a benzene ring substituted by a methyl group, $R^1$ is an alkyl group having 1 to 4 carbon atoms, and $R^2$ is a substituted alkyl group having 1 to 4 carbon atoms. Examples of a group suitable as the substituent by which the alkyl group of $R^2$ may further be substituted include an alkoxy group having 1 to 4 carbon atoms, an aryl group having 6 to 20 carbon atoms, an aryloxy group having 6 to 20 carbon atoms, an alkoxycarbonyl group whose alkoxy moiety contains 1 to 4 carbon atoms, and a substituted or unsubstituted aryloxycarbonyl group whose aryl moiety contains 6 to 20 carbon atoms.

Hereinafter, specific examples of the dye represented by formula (Y3) will be shown, but the present invention is not limited thereto.

Y3-1

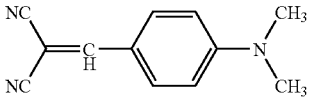

Y3-2

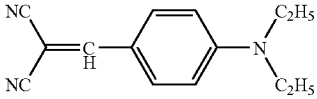

Y3-3

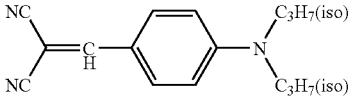

Y3-4

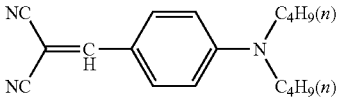

Y3-5

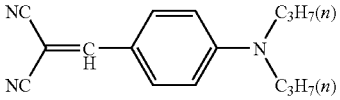

Y3-6

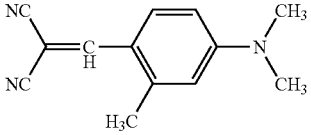

Y3-7

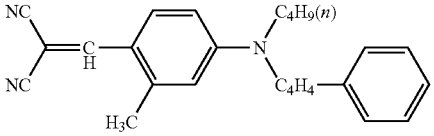

-continued

Y3-8

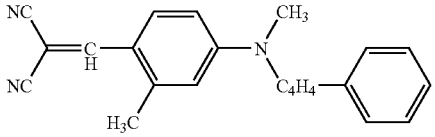

Y3-9

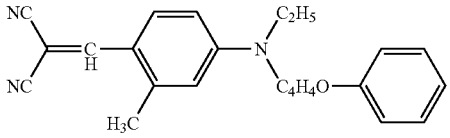

Y3-10

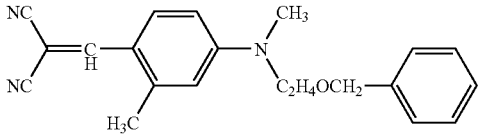

Y3-11

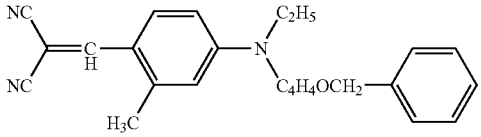

Y3-12

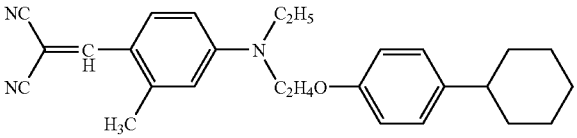

Y3-13

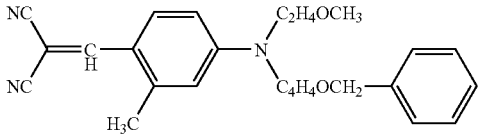

Y3-14

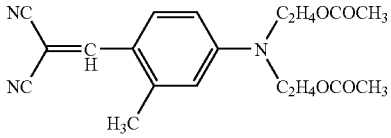

Next, the dye represented by formula (Y4) is explained in detail below.

Formula (Y4)

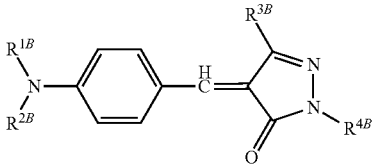

In formula (Y4), $R^{1B}$, $R^{2B}$, $R^{3B}$ and $R^{4B}$ each independently represent a hydrogen atom or a substituent.

Examples of such a substituent include the same substituents as each of the ring A and the substituents $R^1$ and $R^2$ in the formula (Y3) described above may have.

Hereinafter, specific examples of the dye represented by formula (Y4) will be shown, but the present invention is not limited thereto.

Y4-1

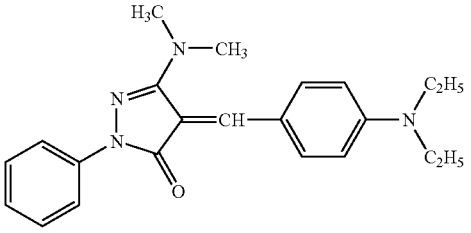

Y4-2

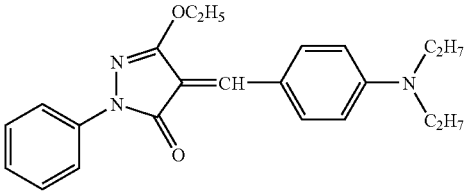

Y4-3

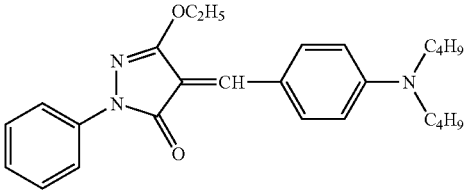

The dyes represented by formula (Y2), (Y3), or (Y4) can be synthesized according to a known method.

In the heat-sensitive transfer layer of the ink sheet that is used in the present invention, use can be made of known dyes that have been used as a magenta dye from the past. Examples of the magenta dye include dyes represented by any one of formulae (M1) to (M5) set forth below. However, the magenta dyes that can be used in the present invention are not limited to these dyes.

The compound represented by formula (M1) is explained below.

Formula (M1)

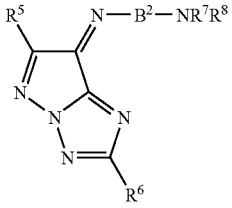

In the formula (M1), $B^2$ represents a substituted or unsubstituted phenylene group or a substituted or unsubstituted divalent pyridine ring group, and $R^5$, $R^6$, $R^7$ and $R^8$ each independently represent a substituted or unsubstituted alkyl group, a substituted or unsubstituted alkenyl group or a substituted or unsubstituted aryl group.

$R^5$, $R^6$, $R^7$ and $R^8$ each may further have a substituent. Examples of a substituent by which each of the groups of $B^2$, $R^5$, $R^6$, $R^7$ and $R^8$ may be substituted include the same substituents as each of the ring A and the substituents $R^1$ and $R^2$ in the formula (Y3) may have.

The phenylene group of $B^2$ is preferably a 1,4-phenylene group which may have a substituent. $B^2$ is more preferably a phenylene group which may have a substituent.

Examples of a preferred combination of the divalent group $B^2$ and the substituents $R^5$ to $R^8$ in a dye represented by the formula (M1) include combinations wherein $B^2$ is an unsubstituted phenylene group, $R^5$ is a substituted or unsubstituted alkyl group having 1 to 8 carbon atoms or a substituted or unsubstituted aryl group having 6 to 10 carbon atoms, $R^6$ is a substituted or unsubstituted alkyl group having 1 to 8 carbon atoms or a substituted or unsubstituted aryl group having 6 to 10 carbon atoms, $R^7$ is a substituted or unsubstituted alkyl group or an allyl group, and $R^8$ is a substituted or unsubstituted alkyl group having 1 to 8 carbon atoms or an allyl group.

In more preferred combinations of the divalent group $B^2$ and the substituents $R^5$ to $R^8$, $B^2$ is an unsubstituted phenylene group, $R^5$ is a substituted or unsubstituted phenyl group, $R^6$ is a substituted or unsubstituted alkyl group having 1 to 8 carbon atoms, $R^7$ is a substituted or unsubstituted alkyl group having 1 to 6 carbon atoms, and $R^8$ is a substituted or unsubstituted alkyl group having 1 to 6 carbon atoms.

In the most preferred combinations, $B^2$ is an unsubstituted phenylene group, $R^5$ is a 2-chlorophenyl group, $R^6$ is a substituted or unsubstituted alkyl group having 1 to 4 carbon atoms, $R^7$ is a substituted or unsubstituted alkyl group having 1 to 4 carbon atoms, and $R^8$ is a substituted or unsubstituted alkyl group having 1 to 4 carbon atoms. When the alkyl group of $R^8$ further has a substituent, the substituent is preferably a cyano group.

Hereinafter, specific examples of the dye represented by formula (M1) will be shown, but the present invention is not limited thereto.

M1-1

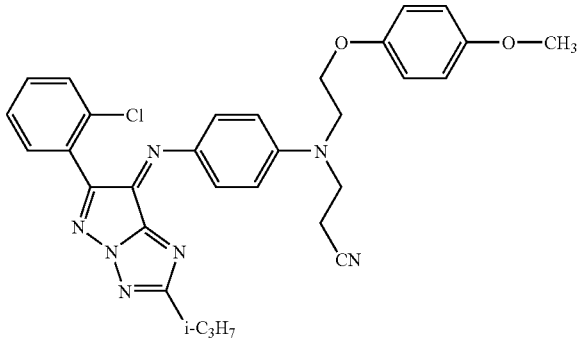

M1-2

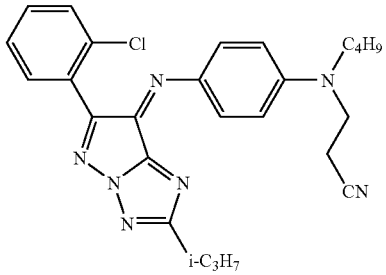

M1-3

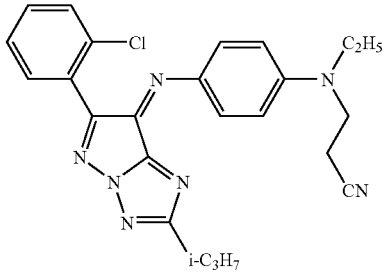

-continued

M1-4

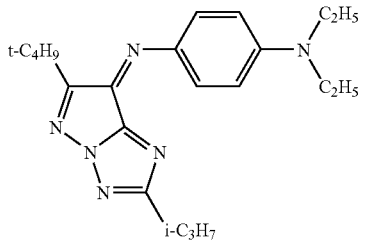

M1-5

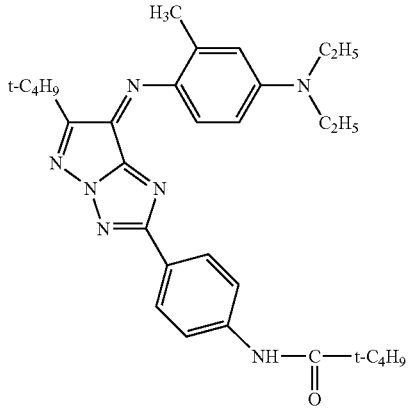

M1-6

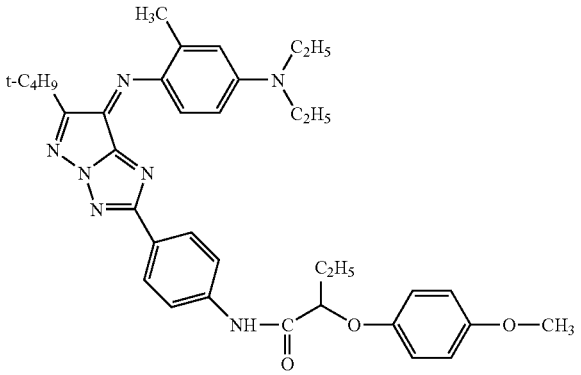

M1-7

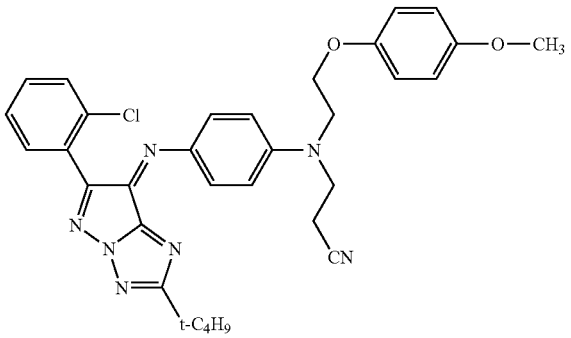

The compound represented by formula (M2) is explained in detail.

Formula (M2)

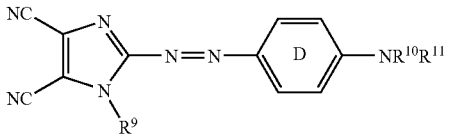

In the formula (M2), the ring D represents a substituted or unsubstituted benzene ring, and $R^9$ represents a hydrogen atom, a substituted or unsubstituted alkyl group, a substituted or unsubstituted alkenyl group or a substituted or unsubstituted aryl group. $R^{10}$ and $R^{11}$ each independently represent a substituted or unsubstituted alkyl group, a substituted or unsubstituted alkenyl group or a substituted or unsubstituted aryl group.

Each of the groups represented by $R^9$, $R^{10}$ and $R^{11}$ may further have a substituent. Examples of a substituent by which the ring D, $R^9$, $R^{10}$ and $R^{11}$ each may be substituted include the same substituents as each of the ring A, $R^1$ and $R^2$ in the formula (Y1) may have.

Examples of a preferred combination of the ring D and the substituents $R^9$ to $R^{11}$ in a dye represented by the formula (M2) include combinations wherein the ring D is a benzene ring substituted by an acylamino group having 2 to 8 carbon atoms, $R^9$ is a substituted or unsubstituted alkyl group having 1 to 8 carbon atoms or an acyl group, $R^{10}$ is a substituted or unsubstituted alkyl group having 1 to 8 carbon atoms or an allyl group, and $R^{11}$ is a substituted or unsubstituted alkyl group having 1 to 8 carbon atoms or an allyl group.

In more preferred combinations of the ring D and the substituents $R^9$ to $R^{11}$, the ring D is a benzene ring substituted by an acylamino group having 2 to 6 carbon atoms, $R^9$ is a substituted or unsubstituted alkyl group having 1 to 6 carbon atoms or an acyl group, $R^{11}$ is a substituted or unsubstituted alkyl group having 1 to 6 carbon atoms or an allyl group, and $R^{11}$ is a substituted or unsubstituted alkyl group having 1 to 6 carbon atoms or an allyl group.

In the most preferred combinations, the ring D is a benzene ring substituted by an acylamino group having 2 to 4 carbon atoms, $R^9$ is a substituted or unsubstituted alkyl group having 1 to 4 carbon atoms or an acyl group, $R^{10}$ is a substituted or unsubstituted alkyl group having 1 to 4 carbon atoms or an allyl group, and $R^{11}$ is a substituted or unsubstituted alkyl group having 1 to 4 carbon atoms or an allyl group.

Hereinafter, specific examples of the dye represented by formula (M2) will be shown, but the present invention is not limited thereto.

M2-1

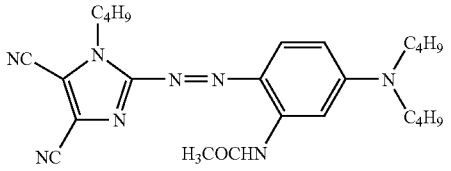

M2-2

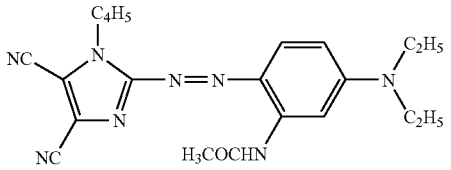

-continued

M2-3

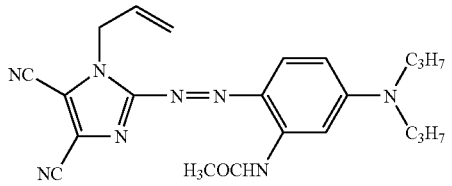

M2-4

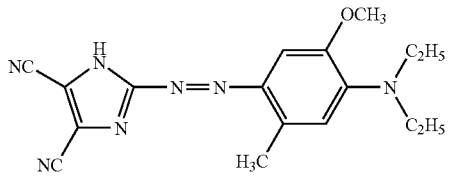

M2-5

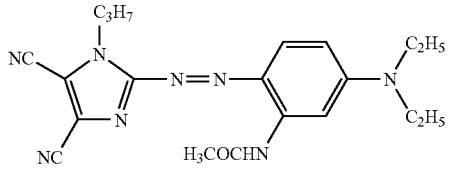

M2-6

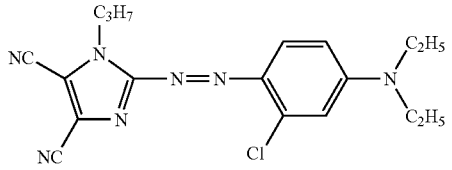

M2-7

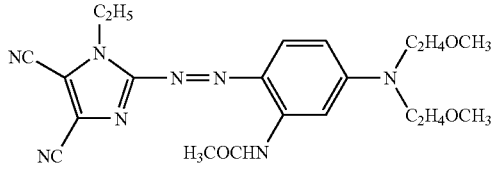

Next, the compound represented by formula (M3) or (M4) is explained in detail.

Formula (M3)

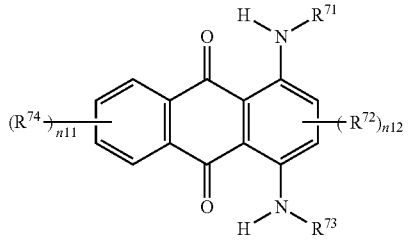

Formula (M4)

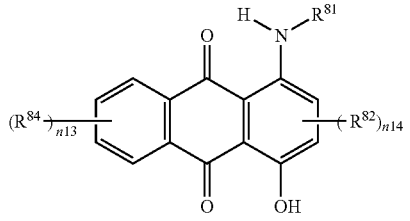

In formula (M3), $R^{71}$ and $R^{73}$ each independently represent a hydrogen atom or a substituent; $R^{72}$ and $R^{74}$ each independently represent a substituent; n11 represents an integer of 0 to 4; n12 represents an integer of 0 to 2; when n11 represents an integer of 2 to 4, $R^{74}$s may be the same or different from each other; and when n12 represents 2, $R^{72}$s may be the same or different from each other.

Examples of the substituents represented by $R^{71}$ to $R^{74}$ include a halogen atom, an alkyl group (including a cycloalkyl group regardless of ring number), an alkenyl group (including a cycloalkenyl group regardless of ring number), an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group (including an alkylamino group and an anilino group), an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each of the above-mentioned substituents may further be substituted.

$R^{71}$ and $R^{73}$ each are preferably a hydrogen atom, a substituted or unsubstituted alkyl group, a substituted or unsubstituted alkenyl group, a substituted or unsubstituted aryl group, or a substituted or unsubstituted heterocyclic group; more preferably a hydrogen atom or a substituted or unsubstituted alkyl group, further preferably a hydrogen atom or a substituted or unsubstituted alkyl group having 1 to 6 carbon atoms, and still furthermore preferably a hydrogen atom.

$R^{72}$ and $R^{74}$ each independently represent a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group or a carbamoyl group; more preferably an alkoxy group, an aryloxy group, an acyloxy group, a carbamoyloxy group, an alkoxycarbonyloxy group, or an aryloxycarbonyloxy group; further preferably an alkoxy group or an aryloxy group. Each of the above-mentioned substituents may further be substituted.

In formula (M4), $R^{81}$ represents a hydrogen atom or a substituent, $R^{82}$ and $R^{84}$ each independently represent a substituent, n13 represents an integer of 0 to 4, and n14 represents an integer of 0 to 2. When n13 represents an integer of 2 to 4, $R^{84}$s may be the same or different from each other. When n14 represents 2, $R^{82}$s may be the same or different from each other. Examples of the substituents each represented by $R^{81}$, $R^{82}$ and $R^{84}$ include those given as examples of the substituent each represented by $R^{71}$ to $R^{74}$ set forth above.

Examples of the substituent represented by $R^{81}$, include those given as examples of the substituents as described about $R^{71}$ and $R^{73}$, and preferable examples thereof are also same. $R^{81}$ is more preferably a hydrogen atom or a substituted or unsubstituted alkyl group having 1 to 6 carbon atoms, and further preferably a hydrogen atom.

Examples of the substituent represented by $R^{82}$ and $R^{84}$ include those given as examples of the substituent as described about $R^{72}$ and $R^{74}$. $R^{82}$ and $R^{84}$ each independently are more preferably an alkoxy group, an aryloxy group, an acyloxy group, a carbamoyloxy group, an alkoxycarbonyloxy group and an aryloxycarbonyloxy group; and further preferably an alkoxy group and an aryloxy group. Each of these groups may be further substituted.

The following is an explanation about a preferable combination of various substituents (atoms) that a dye represented by formula (M3) or (M4) may have: A preferred compound is a compound in which at least one of the substituents is the above-described preferable substituent. A more preferred compound is a compound in which more substituents are the above-described preferable substituents. The most preferred compound is a compound in which all substituents are the above-described preferable substituents.

In the compound represented by formula (M3), it is preferable that $R^{71}$ is a hydrogen atom, $R^{72}$ is an aryloxy group, $R^{73}$ is a hydrogen atom, n11 is an integer of 0, and n12 is an integer of 0 to 2. It is more preferable that $R^{71}$ is a hydrogen atom, $R^{72}$ is an aryloxy group, $R^{73}$ is a hydrogen atom, n11 is integer of 0, and n12 is an integer of 2.

In the compound represented by formula (M4), it is preferable that $R^{81}$ is a hydrogen atom, $R^{82}$ is an aryloxy group, n13 is an integer of 1 to 2, and n14 is an integer of 0. It is more preferable that $R^{81}$ is a hydrogen atom, $R^{82}$ is an aryloxy group, n13 is an integer of 1, and n14 is an integer of 0. It is further preferable that $R^{81}$ is a hydrogen atom, $R^{82}$ is an aryloxy group, n13 is an integer of 1, n14 is an integer of 0, and said $R^{82}$ is positioned at ortho-site to the amino group.

Hereinafter, specific examples of the dyes represented by formula (M3) and (M4) will be shown, but the present invention is not limited thereto.

M3-1

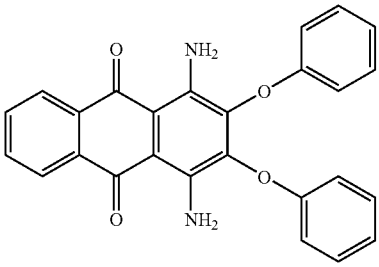

M3-2

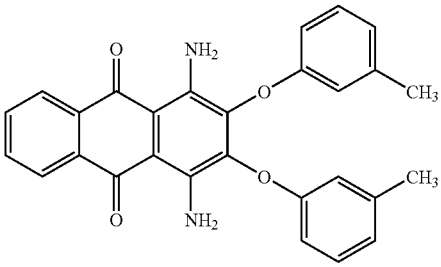

M3-3

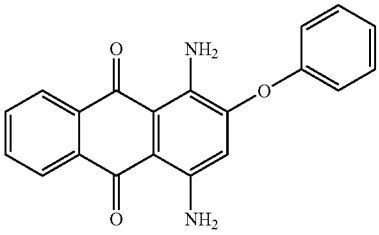

-continued

M3-4

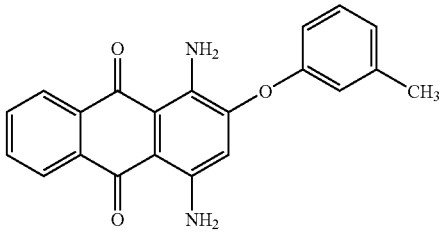

M4-1

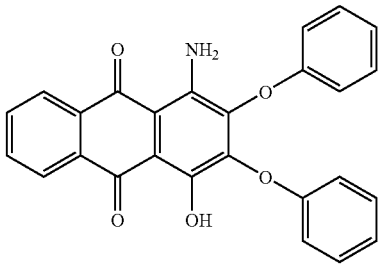

M4-2

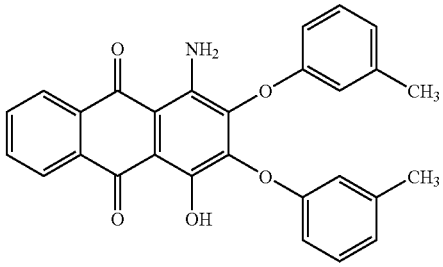

M4-3

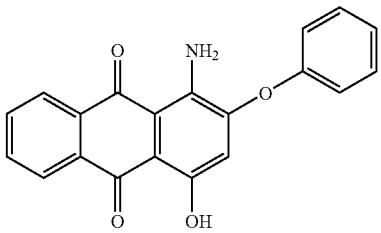

M4-4

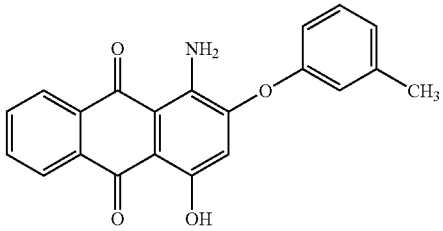

The dyes represents by any one of the formulae (M1) to (M4) can be synthesized referring to a usual method.

In the heat-sensitive transfer layer of the ink sheet that is used in the present invention, use can be made of known dyes that have been used as a cyan dye from the past. Examples of the cyan dye include dyes represented by formula (C1) or (C2) set forth below. However, the cyan dyes that can be used in the present invention are not limited to these dyes.

Next, the dye represented by formula (C1) is explained in detail.

Formula (C1)

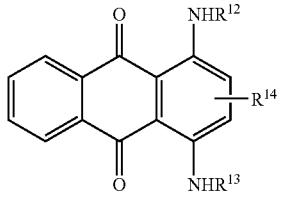

In the formula (C1), $R^{12}$ and $R^{13}$ each independently represent a substituted or unsubstituted alkyl group or a substituted or unsubstituted aryl group. $R^{14}$ represents a hydrogen atom or a substituent.

Each group of $R^{12}$ and $R^{13}$ may further have a substituent. Examples of a substituent by which each group of $R^{12}$ and $R^{13}$ may further be substituted include the same substituents as the ring A and each group of $R^1$ and $R^2$ in the formula (Y3) may have. Examples of the substituent of $R^{14}$ include the same substituents as the ring A and each group of $R^1$ and $R^2$ in the formula (Y3) may have.

Examples of a substituent suitable as $R^{14}$ include a halogen atom, an alkyl group, an alkenyl group, an alkynyl group, an aryl group, a heterocyclic group, a cyano group, an alkoxyl group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or arylsulfonylamino group, an alkylthio group, a sulfamoyl group, an alkyl- or arylsulfinyl group, an alkyl- or arylsulfonyl group, an acyl group, an aryloxycarbonyl group, an alkoxycarbonyl group and a carbamoyl group (which each may further have a substituent). The substituent is preferably a hydrogen atom, a halogen atom, an alkyl group, an alkenyl group, an aryl group, a heterocyclic group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, an alkylthio group, an acyl group, an aryloxycarbonyl group, an alkoxycarbonyl group or a carbamoyl group; more preferably a halogen atom, a substituted or unsubstituted alkyl group having 1 to 4 carbon atoms, a substituted or unsubstituted alkenyl group having 2 to 8 carbon atoms, a substituted or unsubstituted aryl group having 6 to 10 carbon atoms, a substituted or unsubstituted heterocyclic group, an alkoxycarbonyl group or an aryloxycarbonyl group; and further preferably a substituted or unsubstituted alkyl group having 1 to 4 carbon atoms or an alkoxycarbonyl group whose alkoxy moiety contains 1 to 4 carbon atoms.

Examples of a preferred combination of the substituents $R^{12}$ and $R^{13}$ in the formula (C1) include combinations wherein $R^{12}$ is a substituted or unsubstituted alkyl group having 1 to 8 carbon atoms or a substituted or unsubstituted aryl group having 6 to 10 carbon atoms, and $R^{13}$ is a substituted or unsubstituted alkyl group having 1 to 8 carbon atoms or a substituted or unsubstituted aryl group having 6 to 10 carbon atoms.

In more preferred combinations, $R^{12}$ is a substituted or unsubstituted alkyl group having 1 to 6 carbon atoms or a substituted or unsubstituted phenyl group, and $R^{13}$ is a substituted or unsubstituted alkyl group having 1 to 6 carbon atoms or a substituted or unsubstituted phenyl group.

In the most preferred combinations, $R^{12}$ is a substituted or unsubstituted alkyl group having 1 to 4 carbon atoms and $R^{13}$ is a substituted or unsubstituted alkyl group having 1 to 4 carbon atoms or a substituted or unsubstituted phenyl group.

Hereinafter, specific examples of the dye represented by formula (C1) will be shown, but the present invention is not limited thereto.

C1-1

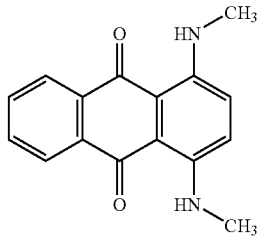

C1-2

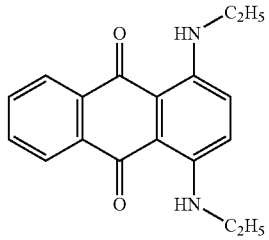

C1-3

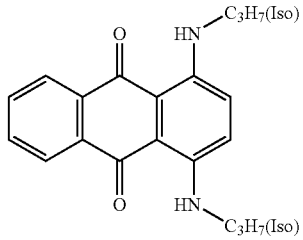

C1-4

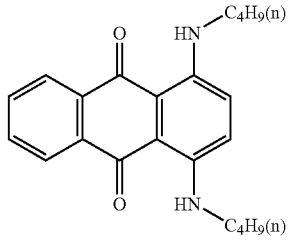

C1-5

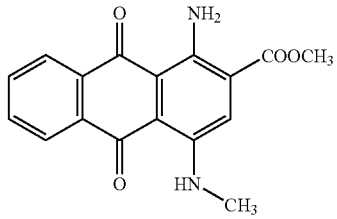

C1-6

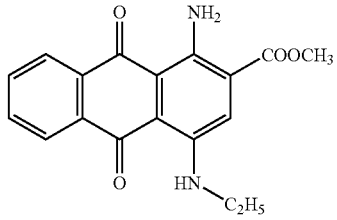

-continued

C1-7

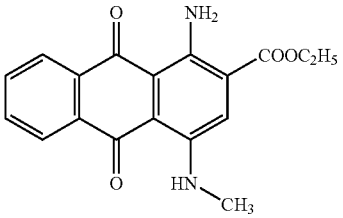

C1-8

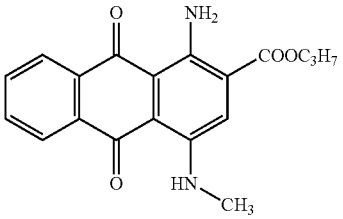

C1-9

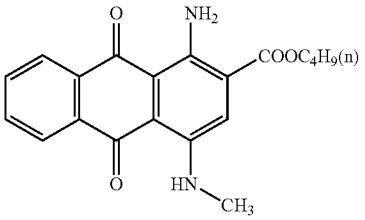

C1-10

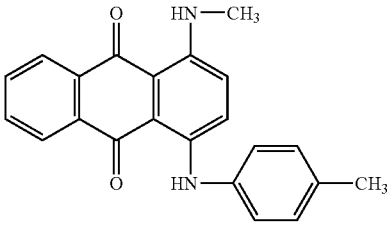

C1-11

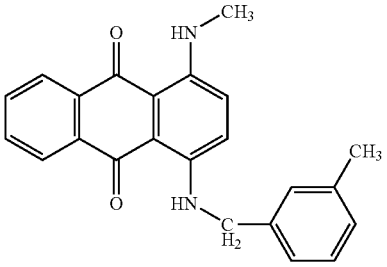

C1-12

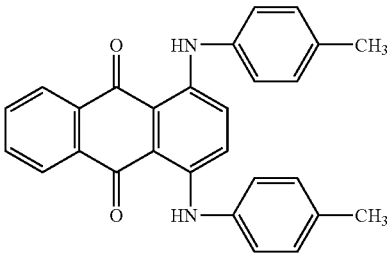

Among the dyes represented by the above-described formula (C1), those not available on the market can be synthesized according to the methods described in publications or specifications of U.S. Pat. Nos. 4,757,046 and 3,770,370, German Patent No. 2316755, JP-A-2004-51873, JP-A-7-137455, and JP-A-61-31292, and J. Chem. Soc. Perkin. Transfer 1,2047 (1977), *Merocyanine Dye-Doner Element Used in thermal Dye Transfer*, authored by Champan.

Next, the dye represented by formula (C2) is explained in detail.

Formula (C2)

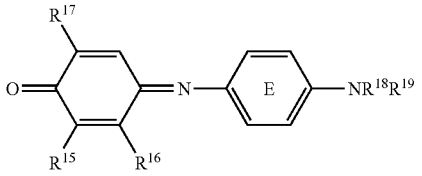

In the formula (C2), the ring E represents a substituted or unsubstituted benzene ring, $R^{15}$ represents a hydrogen atom or a halogen atom, $R^{16}$ represents a substituted or unsubstituted alkyl group, $R^{17}$ represents a substituted or unsubstituted acylamino group or a substituted or unsubstituted alkoxycarbonylamino group, and $R^{18}$ and $R^{19}$ each independently represent a substituted or unsubstituted alkyl group, a substituted or unsubstituted alkenyl group or a substituted or unsubstituted aryl group.

The ring E and each of the groups represented by $R^{16}$, $R^{17}$, $R^{18}$ and $R^{19}$ may further have substituents. Examples of substituents by which the ring E and each of the groups represented by $R^{16}$, $R^{17}$, $R^{18}$ and $R^{19}$ may be substituted are the same substituents as each of the ring A and the substituents $R^1$ and $R^2$ in the formula (Y3) may have.

Examples of a preferred combination of the ring E and the substituents $R^{15}$ to $R^{19}$ include combinations wherein the ring E is a benzene ring substituted by an alkyl group having 1 to 4 carbon atoms, a benzene ring substituted by a chlorine atom or an unsubstituted benzene ring, $R^{15}$ is a hydrogen atom, a chlorine atom or a bromine atom, $R^{16}$ is a substituted or unsubstituted alkyl group having 1 to 8 carbon atoms, $R^{17}$ is a substituted or unsubstituted acylamino group having 2 to 10 carbon atoms or a substituted or unsubstituted alkoxycarbonylamino group having 2 to 10 carbon atoms, $R^{18}$ is a substituted or unsubstituted alkyl group having 1 to 8 carbon atoms, and $R^{19}$ is a substituted or unsubstituted alkyl group having 1 to 8 carbon atoms.

In preferred combinations of the ring E and the substituents $R^{15}$ to $R^{19}$, the ring E is a benzene ring substituted by an alkyl group having 1 to 2 carbon atoms or an unsubstituted benzene ring, $R^{15}$ is a hydrogen atom or a chlorine atom, $R^{16}$ is a substituted or unsubstituted alkyl group having 1 to 6 carbon atoms, $R^{17}$ is a substituted or unsubstituted acylamino group having 2 to 8 carbon atoms or a substituted or unsubstituted alkoxycarbonylamino group having 2 to 8 carbon atoms, $R^{18}$ is a substituted or unsubstituted alkyl group having 1 to 6 carbon atoms, and $R^{19}$ is a substituted or unsubstituted alkyl group having 1 to 6 carbon atoms.

In the most preferred combinations, the ring E is a benzene ring substituted by a methyl group or an unsubstituted benzene ring, $R^{15}$ is a hydrogen atom or a chlorine atom, $R^{16}$ is a substituted or unsubstituted alkyl group having 1 to 6 carbon atoms, $R^{17}$ is a substituted or unsubstituted acylamino group having 2 to 6 carbon atoms or a substituted or unsubstituted alkoxycarbonylamino group having 2 to 6 carbon atoms, $R^{18}$ is a substituted or unsubstituted alkyl group having 1 to 4 carbon atoms, and $R^{19}$ is a substituted or unsubstituted alkyl group having 1 to 4 carbon atoms.

Hereinafter, specific examples of the dye represented by formula (C2) will be shown, but the present invention is not limited thereto.

C2-1

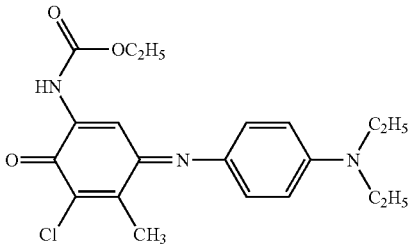

C2-2

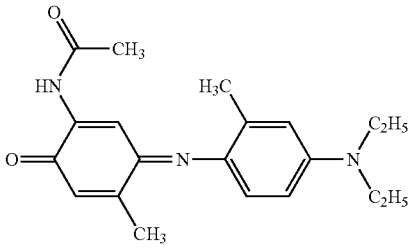

C2-3

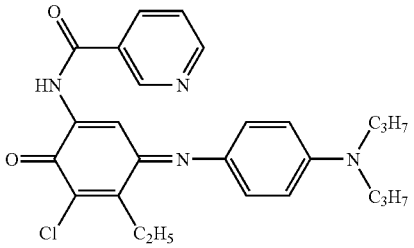

C2-4

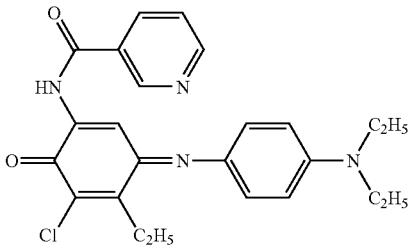

C2-5

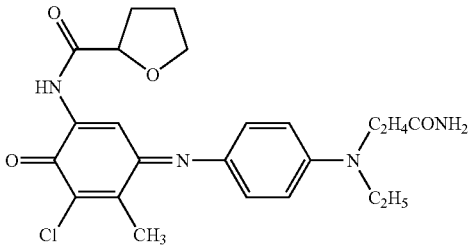

C2-6

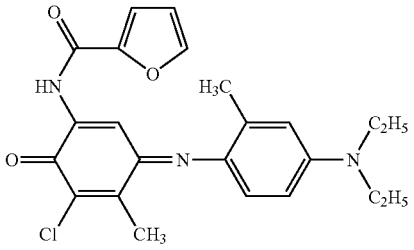

-continued

C2-7

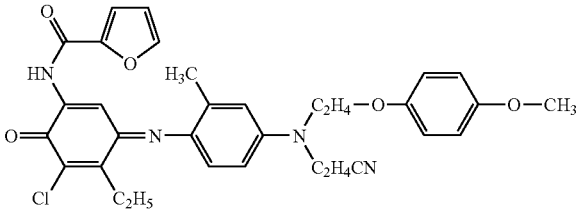

The dyes represented by formula (C2) can be synthesized referring to a usual method.

The dye ink can be prepared by dissolving or dispersing the above-described sublimation type dye and binder resin. As a solvent that is used at the time of preparation, various kinds of known solvents can be used. Examples of the solvent include alcohol-series solvents such as methanol, ethanol, isopropyl alcohol, butanol, and isobutanol; ketone-series solvents such as methylethyl ketone, methylisobutyl ketone, and cyclohexanone; aromatic solvents such as toluene and xylene; and water. The solvents may be used singly, or as a mixture thereof.

In addition to the dye and the binder, various kinds of additives can be added to the dye layers in order to improve various performances such as storage stability, transporting properties in a printer, and releasing properties after printing. As typical additives, organic or inorganic fine particles and waxes are preferably used.

As the organic particles, it is preferred to use fine particles of a resin exemplified by polyolefin resins such as polyethylene and polypropylene, fluorine resins, polyamide resins such as nylon resins, urethane resins, styrene-acryl series crosslinked resins, phenol resins, urea resins, melamine resins, polyimide resins, and benzoguanamine resins. Polyethylene fine particles are more preferably used. As the inorganic particles, it is preferred to use fine particles of, for example, calcium carbonate, silica, clay, talc, titanium oxide, magnesium hydroxide, or zinc oxide.

The organic or inorganic fine particles are preferably contained in a range of from 0.5 to 5 mass %, based on the binder resin of the dye layer ink.

It is also a preferable embodiment that a wax is contained to the dye layer ink in addition to the above-described sublimation type dye, binder, and organic or inorganic fine particles. As the wax that can be used, preferred are waxes derived from petroleum such as microcrystalline wax and paraffin wax; waxes derived from mineral such as montan wax; waxes derived from plants such as carnauba wax, Japan wax and candelilla wax; waxes derived from animals such as bees wax, spermaceti, insect wax and shellac wax; synthetic waxes such as various kinds of low molecular polyethylene, aliphatic acid esters, aliphatic acid amides and silicone wax and partially modified waxes.

Further, another preferable embodiment is to contain resins such as silicone resin, fluorine resin, acrylic resin, cellulose resin, vinyl chloride-vinyl acetate copolymer, and pyroxylin in the dye layer ink. These waxes and resins may be contained in the dye layer ink in the range of preferably from 0.1 mass % to 10 mass %, more preferably from 1 mass % to 3 mass %, based on the total solid content of the dye layer.

Next, explained is a composition of the heat-sensitive sheet of the present invention.

The heat-sensitive transfer sheet according to the present invention has at least one color-providing dye layer disposed on one surface of the support, wherein the dye layer is formed by coating the above-described dye layer ink.

(Base Film)

As the base film, any one of known materials can be used, so far as such the material has both a heat resistance and a mechanical strength necessary to the requirements for the support. Specific examples of preferable base films include thin papers such as a glassine paper, a condenser paper, and a paraffin paper; polyesters having high resistance to heat such as polyethyleneterephthalate, polyethylenenaphthalate, polybutyleneterephthalate, polyphenylene sulfide, polyetherketone, and polyethersulfone; stretched or unstreched films of plastics such as polypropylene, polycarbonate, cellulose acetate, polyethylene derivatives, poly(vinyl chloride), poly (vinylidene chloride), polystyrene, polyamide, polyimide, polymethylpentene, and ionomers; and laminates of these materials. Of these materials, polyester films are especially preferred. Stretched polyester films are most preferred. A thickness of the base film can be properly determined in accordance with the material of the base film so that the mechanical strength and the heat resistance become optimum. Specifically, it is preferred to use a support having a thickness of about 1 μm to about 100 μm, more preferably from about 2 μm to 50 μm, and further preferably from about 3 μm to about 10 μm.

It is essential in the sublimation type heat-sensitive transfer recording system that only a dye with a single hue that is contained in a heat-sensitive transfer sheet must be transferred at the time of printing. Transfer of a resin carrying the dye is not preferred. Therefore, adhesion between the dye layer and the support of the heat-sensitive transfer sheet must be strong. If the adhesion is weak, the dye layer in itself adheres to the heat-sensitive image-receiving sheet, thereby resulting in deterioration of print image quality.

In the case of the base film such as a polyester film exemplified above as a preferable support, wettability of the ink with each hue as described later is not so good that adhesive strength occasionally lacks.

In order to deal with such the problem, it is preferred to employ a method of physically treating a surface of the base film, and/or a method of forming an easy adhesion layer.

It is preferred to form an easy adhesion layer composed of a resin on a base film and to dispose a dye layer on the easy adhesion layer. As a resin for forming the easy adhesion layer, there can be used, for example, urethane resins, polyester resins, polypropylene resins, polyol resins, acrylic resins, and reaction products of these resins and isocyanate compounds. Examples of the isocyanate compound include diisocyanate compounds and triisocyanate compounds, each of which is used from the past. A coating amount is preferably from 0.05 $g/m^2$ to 0.1 $g/m^2$.

In the production of the heat-sensitive transfer sheet, a base film on which an easy adhesion layer is disposed in advance can be used, and a dye layer can be formed on the said support.

(Coating Method for the Dye Layer)

The dye layer that is used in the present invention is formed by coating a dye layer ink on a base film using a gravure printing method or other forming means, followed by drying. The dye layer ink is obtained by dissolving or dispersing, in a proper solvent, heat transferable dyes, a binder resin and optionally used additives such as organic or inorganic finely divided powder and waxes.

A dry thickness of the dye layer is preferably in the range of from about 0.2 $g/m^2$ to about 5 $g/m^2$, more preferably from about 0.4 $g/m^2$ to about 2 $g/m^2$. Content of the sublimation type dye is preferably in the range of from 5 mass % to 90 mass %, more preferably from about 10 mass % to about 70 mass %, based on the dye layer.

Next, the heat-sensitive transfer sheet of the present invention is illustrated in detail by reference to drawings, but these drawings should not be construed as limiting the scope of the present invention. The heat-sensitive transfer sheet according to the present invention should have at least multiple dye layers, as they are separated and unsuperimposed. In the case of the heat-sensitive transfer sheet, on which yellow, magenta, and cyan images are generally printed in that order, so it is preferable that dye layers of different hues, which constitute, as shown in FIG. 1(*a*), a yellow thermal transfer layer Y, a magenta thermal transfer layer M and a cyan thermal transfer layer C, respectively, are provided on one and the same base film in area order. Further, a black layer BK may be disposed as shown in Fig. (b). Furthermore, it is also preferable that, as shown in FIG. 1(*c*), a transferable protective layer laminate 4 as described hereafter is provided between adjacent ink layer groups 3 which each include Y, M, C and BK. However, arrangement of the dye layers with each hue in the present invention is not limited to these disposals, but any arrangement can be employed in accordance with necessity.

Further, releasing properties between the heat-sensitive transfer sheet and the heat-sensitive transfer image-receiving sheet are changed depending on the printing order. Therefore, it is also a preferable embodiment to change content of additives for use in each of the dye layers in response to the change of releasing properties. For example, as a dye layer is used later for printing, it is possible to increase content of the releasing agent in the dye layer.

Figure 2:
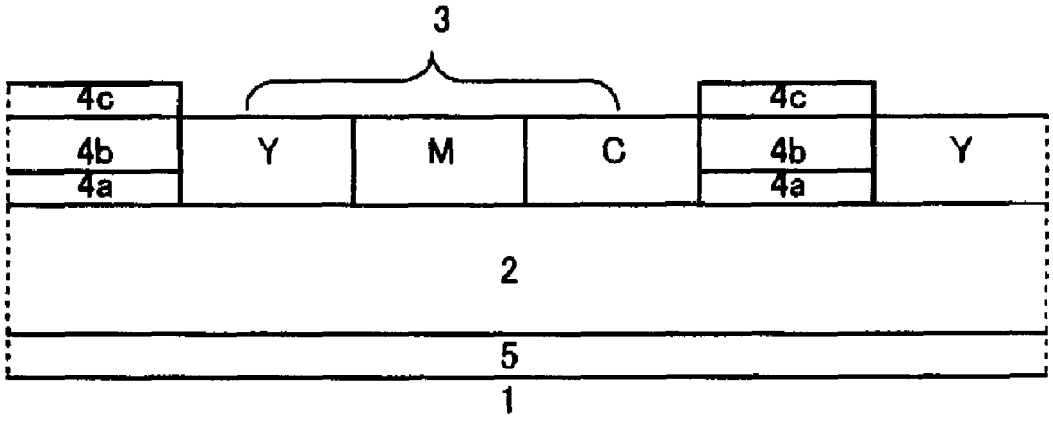
FIG. 2 is a cross-sectional view showing one embodiment of the heat-sensitive transfer ink sheet.

In the heat-sensitive transfer sheet according to the present invention, the dye layer in each color and the transferring protective layer described below may have a single-layer structure or a multi-layer structure of two, three or more layers. In addition, the dye layer in each color may have a single-layered structure and also a multi-layer structure at the same time. In the present invention, at least three kinds of heat-sensitive transfer layers different in kind should be formed on one face of a base film as they are separated and unsuperimposed, but the dye layer in each color may have a multi-layer structure. It is possible, for example, to form multiple layers on a base film by preparing two yellow inks and applying the inks thereon, but not possible to form multiple layers, for example, by coating a yellow ink and a magenta ink on the same position of a base film sequentially. The structure shown in FIG. 2 is indeed one example of such the composite layer structure. Each of the yellow dye layer Y, the magenta dye layer M and the cyan dye layer C has a single layer structure.

A total thickness of the dye layers having a multilayer structure is preferably in the range of from about 0.2 $g/m^2$ to about 5 $g/m^2$, more preferably from about 0.4 $g/m^2$ to about 2 $g/m^2$. A thickness of one constituting layer of the dye layer is preferably in the range of from about 0.2 $g/m^2$ to about 2 $g/m^2$. A total content of the sublimation type dye is preferably in the range of from 5 mass % to 90 mass %, more preferably from about 10 mass % to about 70 mass %, based on the total dye layers.

(Transferable Protective Layer Laminate)

It is a preferable embodiment in the present invention to dispose a transferable protective layer laminate in the heat-sensitive transfer sheet. The transferable protective layer laminate is used to protect a heat-transferred image with a protective layer composed of a transparent resin, thereby to improve durability such as scratch resistance, light-fastness, and resistance to weather. Said protective layer is formed on the heat-transferred image by heat-sensitive transfer. Under the conditions that a dye transferred to the heat-sensitive transfer image-receiving sheet is left to be exposed at the front of the heat-sensitive transfer image-receiving sheet, some of the transferred dyes are unsatisfactory in image durability such as light-fastness, scratch resistance, and chemical resistance. Therefore, it is preferred to dispose the above-described transparent protective layer. As exemplified in FIG. 2 as a preferable embodiment of the heat-resistant transfer sheet according to the present invention, a heat-sensitive slip layer (back layer) 5 is provided on one surface of the base film 2, and a releasing layer 4*a*, a protective layer 4*b* and an adhesive layer 4*c* can be formed as a transferable protective layer laminate 4 on the other surface of the base film in this order from the base film between the ink layer 3 composed of the yellow heat transfer layer Y, the magenta heat transfer layer M and the cyan heat transfer layer C. The protective layer 4*b* may be formed by plural layers. In the case where the protective layer 4*b* also has functions of other layers, the releasing layer 4*a* and the adhesive layer 4*c* can be omitted. It is also possible to use a base film on which an easy adhesive layer has already been formed.

As a protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, mixtures of these resins, ionizing radiation-curable resins, and ultraviolet-shielding resins. In addition, there can be used various kinds of resins that are known from the past as a protective layer-forming resin. Further, in order to give ultraviolet absorbing capacity, or to improve coat separation properties at the time of transfer, gloss, brightness, or the like, it is also preferred to add ultraviolet absorbing agents, antioxidants, fluorescent brightening agents, organic fillers and/or inorganic fillers in accordance with necessity.

As the acrylic resin, use can be made of polymers derived from at least one monomer selected from conventionally known acrylate monomers and methacrylate monomers. Other monomers than these acrylate-series monomers, such as styrene and acrylonitrile may be co-polymerized with said acryl-series monomers. A preferred monomer is methyl methacrylate. It is preferred that methyl methacrylate is contained in terms of preparation mass ratio of 50 mass % or more in the polymer.

As the polyester resin, there can be used conventionally known saturated polyester resins. Examples of an acid component of the polyester resin that can be used in the present invention include aromatic dicarboxylic acids such as terephthalic acid, isophthalic acid, orthophthalic acid, 2,6-naphthalene dicarboxylic acid, tetrahydrophthalic acid, hexahydrophthalic acid, hexahydroisophthalic acid, and hexahydroterephthalic acid; aliphatic dicarboxylic acids such as succinic acid, adipic acid, azelaic acid, sebacic acid, dodecanedionic acid, and dimmer acid; and alicyclic dicarboxylic acids such as cyclohexane dicarboxylic acid, tricyclodecane dicarboxylic acid, and decalin dicarboxylic acid. Methyl-esterified derivatives of these compounds may be also used. Further, acid anhydrides of these compounds may be also used.

Further, if necessary, the above-mentioned compounds may be also used together with other compounds such as p-(hydroxyethoxy)benzoic acid, hydroxypivalic acid, γ-butyryllactone, ϵ-caprolactone, fumaric acid, maleic acid, maleic acid anhydrate, itaconic acid, and citraconic acid. Further, if necessary, the above-mentioned compounds may be also used together with tri- or more multi-functional polycarboxylic acids such as tri or tetra carboxylic acids (e.g., trimellitic acid, pyromellitic acid), in so far as the proportion of the tri- or more multi-functional polycarboxylic acids is 10 mol % or less of the entire carboxylic acid components. Particularly preferred is the composition that contains at least one acid component which is an aromatic dicarboxylic acid a part of which is substituted with a sulfonic acid or a salt thereof, in one molecular chain. It is preferable to conduct polymerization with setting the upper limit of a substitution amount of the sulfonic acid (or salt thereof) within a range that ensures solubility to organic solvents, since this would make it possible to use the polyester resin with mixing with other organic-solvent-soluble additives or resins. As a preferable aromatic dicarboxylic acid substituted with the sulfonic acid (or salt thereof), there are exemplified sulfoterephthalic acid, 5-sulfoisophthalic acid, 4-sulfophthalic acid, 4-sulfonaphthalene-2,7-dicarboxylic acid, 5-(4-sulfophenoxy)isophthalic acid, ammonium salts of these acids, and metal salts of these acids wherein examples of the metal include lithium, potassium, magnesium, calcium, copper, and iron. Of these acids, sodium salt of 5-sulfoisophthalic acid is especially preferred.

Examples of a polyol component that is another component of the polyester resin, include ethylene glycol, 1,2-propylene glycol, 1,3-propane diol, 1,4-butane diol, neopentyl glycol, 1,5-pentane diol, 1,6-hexane diol, 3-methyl-1,5-pentane diol, 1,9-nonane diol, 2-ethyl-2-butylpropane diol, hydroxypivalic acid neopentylglycol ester, dimethylolheptane, and 2,2,4-trimethyl-1,3-pentane diol. If necessary, there can be also used diethylene glycol, triethylene glycol, dipropylene glycol, polyethylene glycol, polypropylene glycol, polytetramethylene glycol, ethylene oxide adducts of neopentyl glycol, and propylene oxide adducts of neopentyl glycol.

As aromatic-group-containing glycols, there are paraxylene glycol, metaxylene glycol, orthoxylene glycol, 1,4-phenylene glycol, ethylene oxide adduct of 1,4-phenylene glycol, bisphenol A, and glycols obtained by adding from 1 to several moles of ethylene oxide or propylene oxide to the two phenolic hydroxyl groups of bisphenols, such as ethylene oxide adducts or propylene oxide adducts of bisphenol A. Examples of alicyclic diol components include tricyclodecane diol, tricyclodecane dimethylol, tricyclodecane dimethanol (TCD-M), cyclohexane diol, 1,4-cyclohexane dimethanol, hydrogenated bisphenol A, ethylene oxide adducts or propylene oxide adducts of hydrogenated bisphenol A. As the above-described polyester resin, a preferable glass transition temperature ranges from 50° C. to 120° C., and a preferable molecular weight ranges from 2,000 to 40,000. A molecular weight ranging from 4,000 to 20,000 is more preferred, because so-called "foil-off" properties at the time of transfer of the protective layer are improved.

The use of the above-described ionizing radiation-curable resins enables to obtain a protective layer that is excellent in both resistance to plasticizers and scratch resistance in particular. As an example, there are resins that are obtained by cross-linking and curing radical polymerizable polymers or oligomers upon irradiation of ionizing radiation. At this moment, polymerization and cross-link may be performed by adding a photopolymerization initiator in accordance with necessity, followed by irradiation of electron beam or ultraviolet ray. Further, known ionizing radiation-curable resins can be used.

It is also a preferable embodiment that the protective layer contains ultraviolet-absorbing agents and/or ultraviolet-shielding resins in order to give light-fastness to the printed matter.

With respect to these ultraviolet-absorbing agents, it is preferred to use a combination of ultraviolet-absorbing agents having a different properties from each other so that an effective ultraviolet-absorbing wavelength region can be covered in accordance with characteristics of the dye that is used for image formation. With respect to the non-reactive ultraviolet-absorbing agents, a mixture of ultraviolet-absorbing agents having a different structure from each other is preferably used in order to prevent the ultraviolet-absorbing agent from deposition.

Examples of the organic fillers and/or the inorganic fillers include polyethylene wax, bis-amide, nylon, acrylic resin, cross-linked polystyrene, silicone resin, silicone rubber, talc, calcium carbonate, titanium oxide, alumina, and silica fine particles such as micro silica and colloidal silica. In the heat-sensitive transfer sheet of the present invention, not only these exemplified materials, but also known other materials can be used suitably.

With respect to the organic fillers and/or the inorganic fillers, it is preferred that a particle diameter of the fillers is 10 μm or less, preferably in the range of from 0.1 μm to 3 μm, and the fillers have good sliding properties and high transparency. An addition amount of the filler is preferably not much more than a degree to which transparency is kept at the time of transfer. Specifically, the addition amount is preferably in the range of from 0 to 100 mass parts, based on 100 mass parts of the resin.

Although characteristics of the protective layer vary depending on the kind of protective layer-forming resin, the protective layer is formed by the same method as the method of forming the above-described dye layer. A thickness of the protective layer is preferably in the range of from about 0.5 μm to about 10 μm.

(Releasing Layer)

In the case where the protective layer 4*b* is difficult to strip from the base film 2 at the time of transfer, it is also a preferable embodiment to form a releasing layer 4*a* between the base film 2 and the protective layer 4*b*. The releasing layer can be formed by the steps of preparing a coating liquid composed of a material that is excellent in release properties, such as waxes, silicone wax, silicone resin, and fluorine resin; a relatively high melting point resin that does not melt by heat transferred from a thermal head, such as cellulosic resin, acrylic resin, polyurethane resin, polyvinyl acetal resin, acrylic vinyl ether resin, maleic acid anhydride resin, silicone resin, fluorine resin; or the above-described resins containing a heat release agent such as waxes, and then coating the coating liquid according to a known coating method such as gravure coat and gravure reverse coat, followed by drying. Of these resins, preferred are acrylic resins obtained by polymerizing acrylic acid or methacrylic acid singly, or copolymerizing acrylic acid or methacrylic acid with other monomers. These acrylic resins are excellent in adhesion to the support, and release properties from the protective layer. Further, these resins may be used alone or in a combination of these resins.

The releasing layer 4*a* remains at the side of a base film at the time of printing (transfer).

A thickness of the layer is preferably in the range of from about 0.5 μm to about 10 μm. Various kinds of particles are incorporated in the releasing layer, or alternatively a surface of the releasing layer at the protective layer-coating side is subjected to a mat treatment, thereby to mat the surface of the releasing layer. Resultantly, the surface of the image-receiving sheet after printing can be mat-finished (flatten).

A separation layer may be formed between the transferable protective layer and the releasing layer. The separation layer is transferred together with the protective layer. After transfer, the separation layer becomes the outermost layer of the printed image-receiving sheet. Therefore, the separation layer is composed of a resin that is excellent in transparency, abrasion resistance and chemical resistance. As the resin, there are exemplified acrylic resin, epoxy resin, polyester resin, and styrene resin. Further, additives such as fillers and waxes may be added to the separation layer.

(Adhesive Layer)

It is preferred to dispose an adhesive layer on the protective layer as the outermost layer of the transferable protective layer laminate. Thereby, transfer properties of the protective layer are improved. In the adhesive layer, there can be used known pressure-sensitive adhesives, heat-sensitive adhesives, and thermoplastic resins. Specific examples of the adhesives include resins that are excellent in adhesiveness at the time of heating, such as polyester resin, vinyl chloride-vinyl acetate copolymer resin, acrylic resin, acrylic material-ultraviolet absorbing agent copolymer resin, ultraviolet absorbing resin, butyral resin, epoxy resin, polyamide resin, vinyl chloride resin, and polycarbonate resin. Of these resins, preferred are thermoplastic resins having a glass transition temperature of from 40° C. to 80° C.

If Tg is less than 40° C., adhesiveness between the coated image and the transparent protective layer tends to become insufficient. On the other hand, if Tg is 80° C. or more, transfer properties of the transparent protective layer tend to become insufficient.

Among these, especially preferred are polyvinylchloride resins, polyvinyl acetate resins, and vinyl chloride-vinyl acetate copolymer resins, each of which has a polymerization degree of from 50 to 300, more preferably from 50 to 250.

As the ultraviolet absorbing resin, there can be used resins such as products that are obtained by reaction and bonding of a thermoplastic resin or an ionizing radiation curable resin with a reactive ultraviolet absorbing agent.

The adhesive layer may contain ultraviolet absorbing agents as described above. Further, it is optional to add other additives such as coloring pigments, white pigments, extender pigments, fillers, antistatic agents, antioxidants, and fluorescent whitening agents in accordance with necessity. The adhesion layer is formed by coating and then drying a coating liquid containing the above-described resin for construction of the adhesion layer, and the above-described additives that are optionally added to the adhesion layer, so that a thickness of the adhesion layer preferably becomes a range of from 0.5 μm to about 10 μm at the dry state. The thickness of the adhesive layer preferably ranges from 0.5 μm to 5 μm, more preferably from 0.5 μm to 3 μm.

(Ultraviolet Absorber)

The ultraviolet absorber preferably absorbs light at wavelengths in the ultraviolet region, and the absorption edge of the absorption of the ultraviolet absorber is preferably out of the visible region. Specifically, after addition of the ultraviolet absorbing agent to a receptor layer so as to form a heat-sensitive transfer image-receiving sheet, it is preferred that the resultant heat-sensitive transfer image-receiving sheet has the maximum absorption in the wavelength region of from 330 nm to 370 nm and has an absorption density Abs of 0.8 or more at the maximum absorption wavelength, more preferably has an absorption density Abs of 0.5 or more at 380 nm. Also, the heat-sensitive transfer image-receiving sheet has an absorption density of, preferably, Abs 0.1 or less at 400 nm. If the absorption density at a wavelength range exceeding 400 nm is high, it is not preferable because an image is made yellowish. As the ultraviolet absorbing agents, use can be made of conventionally known inorganic or organic ultraviolet absorbing agents.

As the organic ultraviolet absorbing agents, use as the ultraviolet-shielding resin can be made of non-reactive ultraviolet absorbing agents such as salicylate-series, benzophenone-series, benzotriazole-series, triazine-series, substituted acrylonitrile-series, nickel chelate-series, and hindered amine-series ultraviolet absorbing agents; and copolymers or graft polymers of thermoplastic resins (e.g., acrylic resins) and activated products obtained by introducing to the above-described non-reactive ultraviolet absorbing agents; addition-polymerizable double bonds originated from a vinyl group, an acryroyl group, a methacryroyl group, or the like, or alternatively by introducing thereto other types of groups such as an alcoholic hydroxyl group, an amino group, a carboxyl group, an epoxy group, and an isocyanate group. Of these ultraviolet absorbing agents, preferred are organic ultraviolet absorbing agents as described below, especially benzophenone-series, benzotriazole-series, and triazine-series ultraviolet absorbing agents.

In addition, disclosed is a method of obtaining ultraviolet-shielding resins by the steps of dissolving ultraviolet absorbing agents in a monomer or oligomer of the resin to be used in the protective layer, and then polymerizing the monomer or oligomer (JP-A-2006-21333). In this case, the ultraviolet absorbing agents may be non-reactive.

Examples of commercially available ultraviolet absorbing agents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISOUB 200 (trade name, manufactured by Sumitomo Chemical Co., Ltd.), BIOSOUP 520 (trade name, manufactured by KYODO CHEMICAL CO., LTD.), and ADKSTAB LA-32 (trade name, manufactured by ADEKA).

In the present invention, the ultraviolet absorber may be made to have a higher molecular weight. In this case, the ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, the polymer containing a unit having ultraviolet absorbing ability (ultraviolet absorber unit) may be made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339 may be used. As the ultraviolet absorber to be used in a form of a latex, the following commercially available ultraviolet absorbers may be used which include ULS-700, ULS-1700, ULS-1383MA, ULS-1635 MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using the polymer containing a unit having ultraviolet absorbing ability in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the polymer containing a unit having ultraviolet absorbing ability or its latex is preferably 5 to 50 parts by mass, and more preferably 10 to 30 parts by mass, to 100 parts by mass of the receptor polymer capable of being dyed or its latex to be used to form the receptor layer.

The ultraviolet absorber may be either an organic compound or an inorganic compound.

In the case of the organic ultraviolet absorber, those represented by the following Formulae (1) to (8) are preferable.

Formula (1)

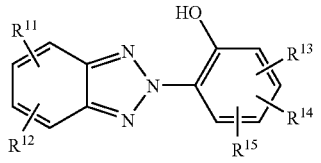

In formula (1), $R^{11}$, $R^{12}$, $R^{13}$, $R^{14}$, and $R^{15}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group.

Formula (2)

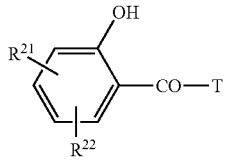

In formula (2), $R^{21}$ and $R^{22}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group. T represents an aryl group, a heterocyclic group, or an aryloxy group. T preferably represents an aryl group.

Formula (3)

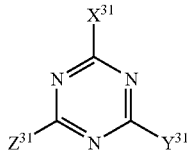

In the formula (3), $X^{31}$, $Y^{31}$ and $Z^{31}$ each independently represent a substituted or unsubstituted alkyl group, aryl group, alkoxy group, aryloxy group, alkylthio group, arylthio group or heterocyclic group. At least one of $X^{31}$, $Y^{31}$ and $Z^{31}$ represents a group represented by the following Formula (a).

Formula (a)

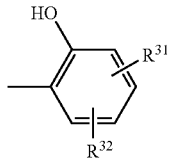

In formula (a), $R^{31}$ and $R^{32}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group. Also, the neighboring $R^{31}$ and $R^{32}$ may be combined to form a ring.

Formula (4)

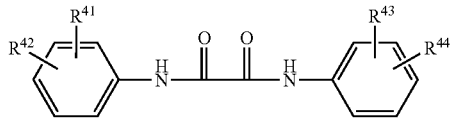

In formula (4), $R^{41}$, $R^{42}$, $R^{43}$, and $R^{44}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group.

Formula (5)

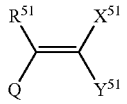

In the formula (5), Q represents an aryl group or a five- or six-membered heterocyclic group, $R^{51}$ represents a hydrogen atom or an alkyl group, $X^{51}$ and $Y^{51}$ each independently represent a cyano group, —$COOR^{52}$, —$CONR^{52}R^{53}$, —$COR^{52}$, —$SO_2OR^{52}$ or —$SO_2NR^{52}R^{53}$, wherein $R^{52}$ and $R^{53}$ each independently represent a hydrogen atom, an alkyl group or an aryl group. One among $R^{52}$ and $R^{53}$ preferably represents a hydrogen atom. Also, $X^{51}$ and $Y^{51}$ may be combined to form a five- or six-membered ring. When $X^{51}$ and $Y^{51}$ are respectively a carboxyl group, they may respectively have a salt form.

Formula (6)

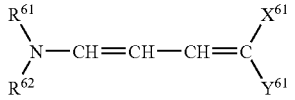

In the formula (6), $R^{61}$ and $R^{62}$ each independently represent a hydrogen atom, an alkyl group or an aryl group, or nonmetal atoms necessary for forming a five- or six-membered ring by bonding with each other. Also, any one of $R^{61}$ and $R^{62}$ may be combined with the methine group adjacent to the nitrogen atom to form a five- or six-membered ring. $X^{61}$ and $Y^{61}$ may be the same or different and have the same meanings as $R^{51}$ and $X^{51}$ in formula (5).

Formula (7)

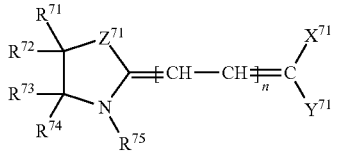

In the formula (7), $R^{71}$, $R^{72}$, $R^{73}$, and $R^{74}$ may be the same or different, and each independently represent a hydrogen atom, an alkyl group or an aryl group, provided that $R^{71}$ and $R^{74}$ may be combined with each other to form a double bond, wherein when $R^{71}$ and $R^{74}$ are combined with each other to form a double bond, $R^{72}$ and $R^{73}$ may be combined with each other to form a benzene ring or a naphthalene ring. $R^{75}$ represents an alkyl group or an aryl group, $Z^{71}$ represents an oxygen atom, a sulfur atom, a methylene group, an ethylene group, >N—$R^{76}$ or >C($R^{77}$)($R^{78}$), where $R^{76}$ represents an alkyl group or an aryl group, and $R^{77}$ and $R^{78}$ may be the same or different and respectively represent a hydrogen atom or an alkyl group. $X^{71}$ and $Y^{71}$ may be the same or different, and have the same meanings as $X^{51}$ and $Y^{51}$ in the formula (5). n denotes 0 or 1.

Formula (8)

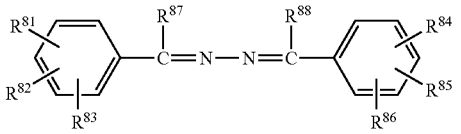

In formula (8), $R^{81}$, $R^{82}$, $R^{83}$, $R^{84}$, $R^{85}$, and $R^{86}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group; $R^{87}$ and $R^{88}$ may be the same or different and each represent a hydrogen atom, an alkyl group, or an aryl group, and $R^{87}$ and $R^{88}$ may bond together to form a 5- or 6-membered ring.

In the formulae (1) to (8) and (a), each substituent in, for example, groups having an alkyl part, aryl part or heterocyclic part may be substituted with the following substituents. In the explanations of each group described in the formulae (1) to (8) and (a), specific examples include exemplified groups of the corresponding groups among the groups shown below.

Such groups will be explained and exemplified hereinbelow.

Specific examples include: a halogen atom (e.g. a chlorine atom, a bromine atom, or an iodine atom); an alkyl group [which represents a substituted or unsubstituted linear, branched, or cyclic alkyl group, and which includes an alkyl group (preferably an alkyl group having 1 to 30 carbon atoms, e.g. a methyl group, an ethyl group, an n-propyl group, an isopropyl group, a t-butyl group, an n-octyl group, an eicosyl group, a 2-chloroethyl group, a 2-cyanoethyl group, or a 2-ethylhexyl group), a cycloalkyl group (preferably a substituted or unsubstituted cycloalkyl group having 3 to 30 carbon atoms, e.g. a cyclohexyl group, a cyclopentyl group, or a 4-n-dodecylcyclohexyl group), a bicycloalkyl group (preferably a substituted or unsubstituted bicycloalkyl group having 5 to 30 carbon atoms, i.e. a monovalent group obtained by removing one hydrogen atom from a bicycloalkane having 5 to 30 carbon atoms, e.g. a bicyclo[1,2,2]heptan-2-yl group or a bicyclo[2,2,2]octan-3-yl group), and a tricyclo or higher structure having three or more ring structures; and an alkyl group in substituents described below (e.g. an alkyl group in an alkylthio group) represents such an alkyl group of the above concept]; an alkenyl group [which represents a substituted or unsubstituted linear, branched, or cyclic alkenyl group, and which includes an alkenyl group (preferably a substituted or unsubstituted alkenyl group having 2 to 30 carbon atoms, e.g. a vinyl group, an allyl group, a prenyl group, a geranyl group, or an oleyl group), a cycloalkenyl group (preferably a substituted or unsubstituted cycloalkenyl group having 3 to 30 carbon atoms, i.e. a monovalent group obtained by removing one hydrogen atom from a cycloalkene having 3 to 30 carbon atoms, e.g. a 2-cyclopenten-1-yl group or a 2-cyclohexen-1-yl group), and a bicycloalkenyl group (which represents a substituted or unsubstituted bicycloalkenyl group, preferably a substituted or unsubstituted bicycloalkenyl group having 5 to 30 carbon atoms, i.e. a monovalent group obtained by removing one hydrogen atom from a bicycloalkene having one double bond, e.g. a bicyclo[2,2,1]hept-2-en-1-yl group or a bicyclo[2,2,2]oct-2-en-4-yl group)]; an alkynyl group (preferably a substituted or unsubstituted alkynyl group having 2 to 30 carbon atoms, e.g. an ethynyl group, a propargyl group, or a trimethylsilylethynyl group); an aryl group (preferably a substituted or unsubstituted aryl group having 6 to 30 carbon atoms, e.g. a phenyl group, a p-tolyl group, a naphthyl group, an m-chlorophenyl group, or an o-hexadecanoylaminophenyl group); a heterocyclic group (preferably a monovalent group obtained by removing one hydrogen atom from a substituted or unsubstituted 5- or 6-membered aromatic or nonaromatic heterocyclic compound; more preferably a 5- or 6-membered aromatic heterocyclic group having 3 to 30 carbon atoms, e.g. a 2-furyl group, a 2-thienyl group, a 2-pyrimidinyl group, a 2-benzothiazolyl group); a cyano group; a hydroxyl group; a nitro group; a carboxyl group; an alkoxy group (preferably a substituted or unsubstituted alkoxy group having 1 to 30 carbon atoms, e.g. a methoxy group, an ethoxy group, an isopropoxy group, a t-butoxy group, an n-octyloxy group, or a 2-methoxyethoxy group); an aryloxy group (preferably a substituted or unsubstituted aryloxy group having 6 to 30 carbon atoms, e.g. a phenoxy group, a 2-methylphenoxy group, a 4-t-butylphenoxy group, a 3-nitrophenoxy group, or a 2-tetradecanoylaminophenoxy group); a silyloxy group (preferably a silyloxy group having 3 to 20 carbon atoms, e.g. a trimethylsilyloxy group or a t-butyldimethylsilyloxy group); a heterocyclic oxy group (preferably a substituted or unsubstituted heterocyclic oxy group having 2 to 30 carbon atoms, e.g. a 1-phenyltetrazol-5-oxy group or a 2-tetrahydropyranyloxy group); an acyloxy group (preferably a formyloxy group, a substituted or unsubstituted alkylcarbonyloxy group having 2 to 30 carbon atoms, or a substituted or unsubstituted arylcarbonyloxy group having 7 to 30 carbon atoms, e.g. a formyloxy group, an acetyloxy group, a pivaloyloxy group, a stearoyloxy group, a benzoyloxy group, or a p-methoxyphenylcarbonyloxy group); a carbamoyloxy group (preferably a substituted or unsubstituted carbamoyloxy group having 1 to 30 carbon atoms, e.g. an N,N-dimethylcarbamoyloxy group, an N,N-diethylcarbamoyloxy group, a morpholinocarbonyloxy group, an N,N-di-n-octylaminocarbonyloxy group, or an N-n-octylcarbamoyloxy group); an alkoxycarbonyloxy group (preferably a substituted or unsubstituted alkoxycarbonyloxy group having 2 to 30 carbon atoms, e.g. a methoxycarbonyloxy group, an ethoxycarbonyloxy group, a t-butoxycarbonyloxy group, or an n-octylcarbonyloxy group); an aryloxycarbonyloxy group (preferably a substituted or unsubstituted aryloxycarbonyloxy group having 7 to 30 carbon atoms, e.g. a phenoxycarbonyloxy group, a p-methoxyphenoxycarbonyloxy group, or a p-n-hexadecyloxyphenoxycarbonyloxy group); an amino group (preferably an amino group, a substituted or unsubstituted alkylamino group having 1 to 30 carbon atoms, or a substituted or unsubstituted arylamino group having 6 to 30 carbon atoms, e.g. an amino group, a methylamino group, a dimethylamino group, an anilino group, an N-methyl-anilino group, or a diphenylamino group); an acylamino group (preferably a formylamino group, a substituted or unsubstituted alkylcarbonylamino group having 1 to 30 carbon atoms, or a substituted or unsubstituted arylcarbonylamino group having 6 to 30 carbon atoms, e.g. a formylamino group, an acetylamino group, a pivaloylamino group, a lauroylamino group, a benzoylamino group, or a 3,4,5-tri-n-octyloxyphenylcarbonylamino group); an aminocarbonylamino group (preferably a substituted or unsubstituted aminocarbonylamino group having 1 to 30 carbon atoms, e.g. a carbamoylamino group, an N,N-dimethylaminocarbonylamino group, an N,N-diethylaminocarbonylamino group, or a morpholinocarbonylamino group); an alkoxycarbonylamino group (preferably a substituted or unsubstituted alkoxycarbonylamino group having 2 to 30 carbon atoms, e.g. a methoxycarbonylamino group, an ethoxycarbonylamino group, a t-butoxycarbonylamino group, an n-octadecyloxycarbonylamino group, or an N-methyl-methoxycarbonylamino group); an aryloxycarbonylamino group (preferably a substituted or unsubstituted aryloxycarbonylamino group having 7 to 30 carbon atoms, e.g. a phenoxycarbonylamino group, a p-chlorophenoxycarbonylamino group, or an m-n-octyloxyphenoxycarbonylamino group); a sulfamoylamino group (preferably a substituted or unsubstituted sulfamoylamino group having 0 to 30 carbon atoms, e.g. a sulfamoylamino group, an N,N-dimethylaminosulfonylamino group, or an N-n-octylaminosulfonylamino group); an alkyl- or aryl-sulfonylamino group (preferably a substituted or unsubstituted alkylsulfonylamino group having 1 to 30 carbon atoms, or a substituted or unsubstituted arylsulfonylamino group having 6 to 30 carbon atoms, e.g. a methylsulfonylamino group, a butylsulfonylamino group, a phenylsulfonylamino group, a 2,3,5-trichlorophenylsulfonylamino group, or a p-methylphenylsulfonylamino group); a mercapto group; an alkylthio group (preferably a substituted or unsubstituted alkylthio group having 1 to 30 carbon atoms, e.g. a methylthio group, an ethylthio group, or an n-hexadecylthio group); an arylthio group (preferably a substituted or unsubstituted arylthio group having 6 to 30 carbon atoms, e.g. a phenylthio group, a p-chlorophenylthio group, or an m-methoxyphenylthio group); a heterocyclic thio group (preferably a substituted or unsubstituted heterocyclic thio group having 2 to 30 carbon atoms, e.g. a 2-benzothiazolylthio group or a 1-phenyltetrazol-5-ylthio group); a sulfamoyl group (preferably a substituted or unsubstituted sulfamoyl group having 0 to 30 carbon atoms, e.g. an N-ethylsulfamoyl group, an N-(3-dodecyloxypropyl)sulfamoyl group, an N,N-dimethylsulfamoyl group, an N-acetylsulfamoyl group, an N-benzoylsulfamoyl group, or an N—(N'-phenylcarbamoyl)sulfamoyl group); a sulfo group; an alkyl- or aryl-sulfinyl group (preferably a substituted or unsubstituted alkylsulfinyl group having 1 to 30 carbon atoms, or a substituted or unsubstituted arylsulfinyl group having 6 to 30 carbon atoms, e.g. a methylsulfinyl group, an ethylsulfinyl group, a phenylsulfinyl group, or a p-methylphenylsulfinyl group); an alkyl- or aryl-sulfonyl group (preferably a substituted or unsubstituted alkylsulfonyl group having 1 to 30 carbon atoms, or a substituted or unsubstituted arylsulfonyl group having 6 to 30 carbon atoms, e.g. a methylsulfonyl group, an ethylsulfonyl group, a phenylsulfonyl group, or a p-methylphenylsulfonyl group); an acyl group (preferably a formyl group, a substituted or unsubstituted alkylcarbonyl group having 2 to 30 carbon atoms, a substituted or unsubstituted arylcarbonyl group having 7 to 30 carbon atoms, or a substituted or unsubstituted heterocyclic carbonyl group having 4 to 30 carbon atoms, which is bonded to said carbonyl group through a carbon atom, e.g. an acetyl group, a pivaloyl group, a 2-chloroacetyl group, a stearoyl group, a benzoyl group, a p-n-octyloxyphenylcarbonyl group, a 2-pyridylcarbonyl group, or a 2-furylcarbonyl group); an aryloxycarbonyl group (preferably a substituted or unsubstituted aryloxycarbonyl group having 7 to 30 carbon atoms, e.g. a phenoxycarbonyl group, an o-chlorophenoxycarbonyl group, an m-nitrophenoxycarbonyl group, or a p-t-butylphenoxycarbonyl group); an alkoxycarbonyl group (preferably a substituted or unsubstituted alkoxycarbonyl group having 2 to 30 carbon atoms, e.g. a methoxycarbonyl group, an ethoxycarbonyl group, a t-butoxycarbonyl group, or an n-octadecyloxycarbonyl group); a carbamoyl group (preferably a substituted or unsubstituted carbamoyl group having 1 to 30 carbon atoms, e.g. a carbamoyl group, an N-methylcarbamoyl group, an N,N-dimethylcarbamoyl group, an N,N-di-n-octylcarbamoyl group, or an N-(methylsulfonyl)carbamoyl group); an aryl- or heterocyclic-azo group (preferably a substituted or unsubstituted aryl azo group having 6 to 30 carbon atoms, or a substituted or unsubstituted heterocyclic azo group having 3 to 30 carbon atoms, e.g. a phenylazo group, a p-chlorophenylazo group, or a 5-ethylthio-1,3,4-thiadiazol-2-ylazo group); an imido group (preferably an N-succinimido group or an N-phthalimido group); a phosphino group (preferably a substituted or unsubstituted phosphino group having 2 to 30 carbon atoms, e.g. a dimethylphosphino group, a diphenylphosphino group, or a methylphenoxyphosphino group); a phosphinyl group (preferably a substituted or unsubstituted phosphinyl group having 2 to 30 carbon atoms, e.g. a phosphinyl group, a dioctyloxyphosphinyl group, or a diethoxyphosphinyl group); a phosphinyloxy group (preferably a substituted or unsubstituted phosphinyloxy group having 2 to 30 carbon atoms, e.g. a diphenoxyphosphinyloxy group or a dioctyloxyphosphinyloxy group); a phosphinylamino group (preferably a substituted or unsubstituted phosphinylamino group having 2 to 30 carbon atoms, e.g. a dimethoxyphosphinylamino group or a dimethylaminophosphinylamino group); a silyl group (preferably a substituted or unsubstituted silyl group having 3 to 30 carbon atoms, e.g. a trimethylsilyl group, a t-butyldimethylsilyl group, or a phenyldimethylsilyl group).

Among the substituents, with respect to one having a hydrogen atom, the hydrogen atom may be removed and be substituted by any of the above-mentioned substituents. Examples thereof include: an alkylcarbonylaminosulfonyl group, an arylcarbonylaminosulfonyl group, an alkylsulfonylaminocarbonyl group, and an arylsulfonylaminocarbonyl group. Specific examples thereof include a methylsulfonylaminocarbonyl group, a p-methylphenylsulfonylaminocarbonyl group, an acetylaminosulfonyl group, and a benzoylaminosulfonyl group.

When the ultraviolet absorber represented by any one of the formulas (1) to (8) is water-soluble, it is preferred to have an ionic hydrophilic group. The ionic hydrophilic group includes a sulfo group, a carboxyl group, a phosphono group, and a quaternary ammonium group. As the ionic hydrophilic group, a carboxyl group, a phosphono group, and a sulfo group are preferred, and a carboxyl group and a sulfo group are particularly preferred. The carboxyl group, phosphono group, and sulfo group may be in the state of a salt, and the examples of the counter ions for forming the salts include an ammonium ion, an alkali metal ion (e.g., a lithium ion, a sodium ion, and a potassium ion), and an organic cation (a tetramethylammonium ion, a tetramethylguanidium ion, and a tetramethylphosphonium ion).

Among ultraviolet absorbers represented by any one of the Formulae (1) to (8), those represented by any one of the Formulae (1) to (4) are preferable in the point that they themselves have high light fastness, and those represented by any one of the Formulae (1) to (3) are further preferable in view of absorbing characteristics. Among these absorbers, those represented by the Formula (1) or (3) are particularly preferable. In the case where the ultraviolet absorber is used in a basic condition, on the other hand, compounds represented by any one of the Formulae (4) to (8) are preferable from the viewpoint of preventing coloring caused by dissociation.

The compounds represented by any one of the formulae (1) to (8) can be synthesized by or according to any of the methods described, for example, in JP-B-48-30492 ("JP-B" means examined Japanese patent publication), JP-B-55-36984, JP-B-55-125875, JP-B-36-10466, JP-B-48-5496, JP-A-46-3335, JP-A-58-214152, JP-A-58-221844, JP-A-47-10537, JP-A-59-19945, JP-A-63-53544, JP-A-51-56620, JP-A-53-128333, JP-A-58-181040, JP-A-6-211813, JP-A-7-258228, JP-A-8-239368, JP-A-8-53427, JP-A-10-115898, JP-A-10-147577, JP-A-10-182621, JP-T-8-501291 ("JP-T" means searched and published International patent publication), U.S. Pat. No. 3,754,919, U.S. Pat. No. 4,220,711, U.S. Pat. No. 2,719,086, U.S. Pat. No. 3,698,707, U.S. Pat. No. 3,707,375, U.S. Pat. No. 5,298,380, U.S. Pat. No. 5,500,332, U.S. Pat. No. 5,585,228, U.S. Pat. No. 5,814,438, British Patent No. 1,198,337, European Patent No. 323408A, No. 520938A, No. 521823A, No. 531258A, No. 530135A, and No. 520938A.

Also, the structures, material properties and action mechanisms of typical ultraviolet absorbers are described in Andreas Valet, "Light Stabilizers for Paint", issued by Vincentz.

(Heat-Resistant Slipping Layer)

The back surface of the heat-sensitive transfer sheet directly contacts with a heating device such as a thermal head, and the sheet is transported while the back surface is heated. When printing is carried out at a high speed, the thermal head temperature becomes higher. Therefore, it is required to dispose a heat resistant slip layer 5 on the back surface of the base film in order to smooth the transporting by preventing the back surface from being heat sealed with the heating device such as a thermal head.

In the heat resistant slip layer, there can be used natural or synthetic resins such as cellulosic resins (for example, ethyl cellulose, hydroxy cellulose, hydroxypropyl cellulose, methyl cellulose, cellulose acetate, cellulose acetate butyrate, and nitro cellulose), vinyl-series resins (for example, polyvinyl alcohol, polyvinyl acetate, polyvinyl butyral, polyvinyl acetal, and polyvinyl pyrrolidone), acrylic resins (for example, polymethyl methacrylate, polyethyl methacrylate, polyacryl amide, and acrylonitrile-styrene copolymer), polyamide resins, polyvinyl toluene resins, cumarone indene resins, polyester-series resins, polyurethane resins, silicone-modified or fluorine-modified urethane resins, and silicone resins, and mixtures of these resins.

In order to improve heat resistance of the heat resistant slip layer, it is a preferable embodiment that the back layer is modified with a crosslinking agent into a crosslinked resin layer.

Further to improve transporting, it is preferable to contain a solid or liquid releasing agent or sliding agent in the heat resistant slip layer. As the solid or liquid releasing agent or sliding agent, known compounds can be used. Examples of these compounds include various kinds of waxes such as carnauba wax, montan wax, polyethylene wax, and paraffin wax, zinc stearate, stearic acid amide, higher aliphatic acid alcohol, organopolysiloxane, anionic surfactants, cationic surfactants, amphoteric surfactants, nonionic surfactants, fluorine-series surfactants, organic carboxylic acid and their derivatives, fluorine-series resins, silicone-series resin, phosphate-series compounds, and organic or inorganic fine particles.

Such the heat resistant slip layer can be formed using a known coating method. A thickness of the back layer is preferably in the range of from 0.1 μm to 10 μm, more preferably from 0.3 μm to 5 μm, and especially preferably from 0.5 μm to 3 μm.

2) Image Formation

In the image-forming method (system) of the present invention, imaging is achieved by superposing a heat-sensitive (thermal) transfer sheet on a heat-sensitive (thermal) transfer image-receiving sheet so that a heat-sensitive transfer layer of the heat-sensitive transfer sheet is in contact with a receptor layer of the heat-sensitive transfer image-receiving sheet and giving thermal energy in accordance with image signals given from a thermal head.

Specifically, image-forming can be achieved by the similar manner to that as described in, for example, JP-A-2005-88545. In the present invention, a printing time is preferably less than 15 seconds, and more preferably in the range of 3 to 12 seconds, furthermore preferably 3 to 7 seconds, from the viewpoint of shortening a time taken until a consumer gets a print.

The advantages of the present invention are more distinctive when used for high-speed printing wherein the images are formed on the heat-sensitive transfer layer with a thermal head at a speed of 100 mm/second or more, most preferably of 110 mm/second or more.

The line speed during printing is preferably 1.0 msec/line or less, more preferably 0.8 msec/line or less, and most preferably 0.65 msec/line. Further, from the viewpoint of improvement in transfer efficiency as one of speeding-up conditions, the maximum ultimate temperature of the thermal head at the time of printing is preferably in the range of from 180° C. to 450° C., more preferably from 200° C. to 450° C., and furthermore preferably from 350° C. to 450° C.

The method or system of the present invention may be utilized for printers, copying machines and the like, which employs a heat-sensitive transfer recording system. Any known energy-providing means may be used as the means for providing heat energy during heat-sensitive transfer, for example, in low-speed printing machines such as Video Printer VY-100 (trade name, manufactured by Hitachi) and also in high-speed printing machines such as ASK2000 (trade name, manufactured by Fuji Photo Film Co., Ltd.). It is also possible to apply the heat-sensitive transfer sheet according to the present invention to various applications such as reflective print, cards, and transparent print, by properly selecting the support of the heat-sensitive transfer image-receiving sheet.

3) Heat-Sensitive Transfer Image-Receiving Sheet

First, the heat-sensitive transfer image-receiving sheet (hereinafter also referred to as an image-receiving sheet) that can be used in the present invention will be explained.

The heat-sensitive (thermal) transfer image-receiving sheet that can be used in the present invention is provided with at least one dye-receiving layer (receptor layer) on a support, and at least one heat insulation layer (porous layer) between the support and the receptor layer. Moreover, an undercoat layer such as a white-background-control layer, a charge-control layer (an electrification-control layer), an adhesive layer, and a primer layer, may be provided between the receptor layer and the heat insulation layer.

The receptor layer and the heat insulation layer are preferably formed by a simultaneous multi-layer coating. When the undercoat layer is provided, the receptor layer, the undercoat layer, and the heat insulation layer may be formed by the simultaneous multi-layer coating.

It is preferable that a curling control layer, a writing layer, or a charge-control layer be formed on the backside of the support. Each of these layers may be applied using a usual method such as a roll coating, a bar coating, a gravure coating, and a gravure reverse coating.

<Receptor Layer>

[Thermoplastic Resin]

In the present invention, a thermoplastic resin is preferably used in the receptor layer. Examples of the thermoplastic resin (polymer) that is preferably used in the receptor layer in the present invention include vinyl-series resins, such as halogenated polymers (e.g., polyvinyl chloride and polyvinylidene chloride), polyvinyl acetate, ethylene-vinyl acetate copolymer, vinyl chloride-vinyl acetate copolymer, polyacryl ester, polystyrene, and polystyrene acrylate; acetal-series resins, such as polyvinylformal, polyvinylbutyral and polyvinylacetal; polyester-series resins, such as polyethylene terephthalate, polybutylene terephthalate and polycaprolactone (e.g., PLACCEL H-5 (trade name) manufactured by DAICEL CHEMICAL INDUSTRIES, LTD.); polycarbonate-series resins; cellulose-series resins, such as those described in JP-A-4-296595 and JP-A-2002-264543; cellulose-series resins, such as cellulose acetate butyrate (e.g., CAB551-0.2 and CAB321-0.1 (each trade name) manufactured by Eastman Chemical Company); polyolefin-series resins, such as polypropylene; and polyamide-series resins, such as urea resins, melamine resins and benzoguanamine resins. These resins may be used optionally blending with each other in the range of compatibility. Resins used for forming the receptor layer are also disclosed in JP-A-57-169370, JP-A-57-207250 and JP-A-60-25793.

It is further preferable that, among these polymers, the receptor layer preferably contain a polycarbonate, a polyester, a polyurethane, a polyvinyl chloride or its copolymer, a styrene-acrylonitrile copolymer, a polycaprolactone, or a mixture of two or more of these. It is particularly preferable that the receptor layer contain a polycarbonate, a polyester, a polyvinyl chloride or its copolymer, or a mixture of two or more of these. The following is a more detailed explanation of polycarbonate, polyester, and polyvinyl chloride. Incidentally, these polymers may be used singly or as mixtures thereof.

(Polyester Polymers)

The polyester polymers that can be used in the receptor layer in the present invention are explained in more detail.

The polyester polymers are obtained by polycondensation of a dicarboxylic acid component (including a derivative thereof) and a diol component (including a derivative thereof). The polyester polymers preferably contain an aromatic ring and/or an aliphatic ring. As to technologies related to the alicyclic polyester, those described in JP-A-5-238167 are useful from the viewpoints of ability to incorporate a dye and image stability.

Examples of the dicarboxylic acid component include adipic acid, azelaic acid, isophthalic acid, trimellitic acid, terephthalic acid, 1,4-cyclohexane dicarboxylic acid, and a mixture of two or more of these acids. The dicarboxylic acid component is preferably isophthalic acid, trimellitic acid, terephthalic acid, or a mixture of two or more of these acids. From a viewpoint of improvement in light resistance, a dicarboxylic acid component having an alicyclic structure is more preferable as the dicarboxylic acid component. The dicarboxylic acid component is further preferably 1,4-cyclohexane dicarboxylic acid or isophthalic acid. Specifically, as the dicarboxylic acid component, a mixture of isophthalic acid in an amount of 50 to 100 mol %, trimellitic acid in an amount of 0 to 1 mol %, terephthalic acid in an amount of 0 to 50 mol %, and 1,4-cyclohexane dicarboxylic acid in an amount of 0 to 15 mol %, in which a total amount of these components is 100 mol %, is furthermore preferably used.

Examples of the diol component include ethylene glycol, polyethylene glycol, tricyclodecane dimethanol, 1,4-butanediol, bisphenol, and a mixture of two or more of these diols. The diol component is preferably ethylene glycol, polyethylene glycol or tricyclodecane dimethanol. From a viewpoint of improvement in light resistance, a diol component having an alicyclic structure is more preferable as the diol component. Use can be made of an alicyclic diol component such as cyclohexanediol, cyclohexanedimethanol and cyclohexanediethanol, in addition to tricyclodecane dimethanol. The alicyclic diol component is preferably tricyclodecane dimethanol. Specifically, as the diol component, a mixture of ethylene glycol in an amount of 0 to 50 mol %, polyethylene glycol in an amount of 0 to 10 mol %, tricyclodecane dimethanol in an amount of 0 to 90 mol % (preferably from 30 to 90 mol %, more preferably from 40 to 90 mol %), 1,4-butanediol in an amount of 0 to 50 mol %, and bisphenol A in an amount of 0 to 50 mol %, in which a total amount of these components is 100 mol %, is furthermore preferably used.

In the present invention, as the polyester polymers, it is preferable to use polyester polymers obtained by polycondensation using at least one of the above-described dicarboxylic acid component and at least one of the above-described diol component, so that the thus-obtained polyester polymers could have a molecular weight (mass average molecular weight (Mw)) of generally about 11,000 or more, preferably about 15,000 or more, and more preferably about 17,000 or more. If polyester polymers of too low molecular weight are used, elastic coefficient of the formed receptor layer becomes low and also it raises lack of thermal resistance. Resultantly, it sometimes becomes difficult to assure the releasing property of the heat-sensitive transfer sheet and the image-receiving sheet. A higher molecular weight is more preferable from a viewpoint of increase in elastic coefficient. The molecular weight is not limited in particular, so long as such failure does not occur that a higher molecular weight makes the polymer difficult to be dissolved in a solvent for a coating solution at the time of forming the receptor layer, or that an adverse effect arises in adhesive properties of the receptor layer to a substrate sheet after coating and drying the receptor layer. However, the molecular weight is preferably about 25,000 or less, and at highest a degree of about 30,000. The polyester polymers may be synthesized according to a known method.

Examples of a saturated polyester used as the polyester polymers, include VYLON 200, VYLON 290 and VYLON 600 (each trade name, manufactured by Toyobo Co., Ltd.), KA-1038C (trade name, manufactured by Arakawa Chemical Industries, Ltd.), and TP220 and TP235 (each trade name, manufactured by The Nippon Synthetic Chemical Industry Co., Ltd.).

(Polycarbonate Polymers)

The polycarbonate-series polymer that can be used in the receptor layer in the present invention is explained in more detail.

The polycarbonate polymers mean a polyester composed of a carbonic acid and a diol as a unit. The polycarbonate polymers can be synthesized by, for example, a method in which a diol and a phosgene are reacted or a method in which a diol and a carbonic acid ester are reacted.

Examples of the diol component include bisphenol A, ethylene glycol, propylene glycol, diethylene glycol, butanediol, pentanediol, hexanediol, 1,4-cyclohexanedimethanol, nonanediol, 4,4'-bicyclo(2,2,2,)hepto-2-ylidene bisphenol, 4,4'-(octahydro-4,7-methano-5H-indene-5-ylidene)bisphenol and 2,2',6,6'-tetrachloro bisphenol A. Preferred are bisphenol A, ethylene glycol, diethylene glycol, butanediol and pentanediol. More preferred are bisphenol A, ethylene glycol and butanediol. Especially preferred are bisphenol A and ethylene glycol. As for the polycarbonate polymers used in the present invention, at least one of the above-described diol components is used. A plurality of diols may be used as a mixture thereof.

The following is a detailed explanation of a bisphenol A-polycarbonate that is an especially preferred embodiment.

Technologies related to unmodified polycarbonates that center around the bisphenol A-polycarbonate are described in U.S. Pat. No. 4,695,286. The polycarbonate polymers that can be used in the present invention are a polycondensation compound having a molecular weight (weight average molecular weight (Mw)) of generally about 1,000 or more, preferably about 3,000 or more, more preferably about 5,000 or more, and especially preferably about 10,000 or more. Specific examples of the polycarbonate polymers include Makrolon-5700 (trade name, manufactured by Bayer AG) and LEXAN-141 (trade name, manufactured by General Electric Corporation).

Technologies of producing modified polycarbonates by mixing bisphenol A with a diol such as ethylene glycol are described in U.S. Pat. No. 4,927,803. The polyether block unit may be produced from a linear aliphatic diol having 2 to about 10 carbon atoms. But, a polyether block unit produced from ethylene glycol is preferred. In a preferred embodiment of the present invention, the polyether block unit has a number molecular weight of about 4,000 to about 50,000, while the bisphenol A-polycarbonate block unit has a number molecular weight of about 15,000 to about 250,000. A molecular weight of the whole block copolymer is preferably in the range of about 30,000 to about 300,000. Specific examples thereof include Makrolon KL3-1013 (trade name, manufactured by Bayer AG).

It is also preferable that these unmodified and modified bisphenol A-polycarbonates are mixed together. Specifically, it is preferred to blend an unmodified bisphenol A-polycarbonate with a polyether-modified polycarbonate in a ratio by mass of from 80:20 to 10:90. The ratio by mass of from 50:50 to 40:60 is especially preferred from a viewpoint of improvement in resistance to finger print. Technologies of blending the unmodified and modified bisphenol A-polycarbonates are also described in JP-A-6-227160.

As for a preferable embodiment of the thermoplastic resin (polymers) used in the receptor layer, use can be made of a blend of the above-described polycarbonate polymers and the above-described polyester polymers. In the blend, it is preferred to secure compatibility of the polycarbonate polymers and the polyester polymers. The polyester polymers preferably have a glass transition temperature (Tg) of about 40° C. to about 100° C., and the polycarbonate polymers preferably have a Tg of about 100° C. to about 200° C. It is preferable that the polyester polymers have a Tg lower than that of the polycarbonate polymers and act as a plasticizer to the polycarbonate polymers. A preferable Tg of a finished polyester/polycarbonate blend is in the range of 40° C. to 100° C. Even though a polyester/polycarbonate blend polymer has a higher Tg, it may be used advantageously by addition of a plasticizer.

In a further preferable embodiment, an unmodified bisphenol A-polycarbonate and polyester polymers are blended in such a ratio by mass that a Tg of the finished blend not only becomes a preferable value but also a cost can be controlled to the minimum. The polycarbonate polymers and the polyester polymers can be blended advantageously in a ratio by mass of approximately from 75:25 to 25:75. It is more preferable to blend them in a ratio by mass of from about 60:40 to about 40:60. Technologies of a blend series of the polycarbonate polymers and the polyester polymers are disclosed in JP-A-6-227161.

As for the polycarbonate polymers used in the receptor layer, a net structure of a crosslinked polymer may be formed in the receptor layer by reacting a polycarbonate having an average molecular weight of about 1,000 to about 10,000, the ends of which have at least 2 hydroxyl groups, with a crosslinking agent capable of reacting with the hydroxyl groups. As described in JP-A-6-155933, there are known technologies for a crosslinking agent such as a multifunctional isocyanate, thereby to improve adhesiveness to a dye donator after transfer. Besides, as the technologies disclosed in JP-A-8-39942, there are technologies in which a receiving sheet for a heat-sensitive dye transfer process is constructed using dibutyl tin diacetate at a time of crosslinking reaction of a polycarbonate with isocyanate. Such the technologies enable to improve not only acceleration of the crosslinking reaction, but also image stability, resistance to finger print, and the like.

(Vinyl Chloride-Series Polymers)

The vinyl chloride-series polymers, particularly a copolymer using vinyl chloride, used in the receptor layer are explained in more detail.

The polyvinyl chloride-series copolymer is preferably one having a vinyl chloride constituent content of 85 to 97% by mass and a polymerization degree of 200 to 800. A monomer forming such a copolymer together with vinyl chloride has no particular restrictions, and any monomer may be used as far as it can be copolymerized with vinyl chloride. However, it is particularly preferably vinyl acetate. Accordingly, the polyvinyl chloride copolymer used in the receptor layer is advantageously a vinyl chloride-vinyl acetate copolymer. However, the vinyl chloride-vinyl acetate copolymer is not necessarily constituted of vinyl chloride and vinyl acetate alone, and may include vinyl alcohol and maleic acid constituents to an extent to which the effects of the present invention would be obtained. Examples of other monomer constituents of such a copolymer constituted mainly of vinyl chloride and vinyl acetate include vinyl alcohol and its derivatives such as vinyl propionate; acrylic or methacrylic acids and their derivatives such as their methyl, ethyl, propyl, butyl and 2-ethylhexyl esters; maleic acid and its derivatives such as diethyl maleate, dibutyl maleate and dioctyl maleate; vinyl ether derivatives such as methyl vinyl ether, butyl vinyl ether and 2-ethylhexyl vinyl ether; acrylonitrile and methacrylonitrile; and styrene. The ratio of each of the vinyl chloride and vinyl acetate components in the copolymer may be any ratio, but it is preferable that the ratio of the vinyl chloride component is 50 mass % or more of the copolymer. In addition, it is preferable that the ratio of the above-recited constituents other than the vinyl chloride and vinyl acetate is 10 mass % or less of the copolymer.

Examples of such a vinyl chloride-vinyl acetate copolymer include SOLBIN C, SOLBIN CL, SOLBIN CH, SOLBIN CN, SOLBIN C5, SOLBIN M, SOLBIN MF, SOLBIN A, SOLBIN AL, SOLBIN TA5R, SOLBIN TAO, SOLBIN MK6, and SOLBIN TA2 (trade names, manufactured by Nissin Chemical Industry Co., Ltd.); S-LEC A, S-LEC C and S-LEC M (trade names, manufactured by Sekisui Chemical Co., Ltd.); Vinylite VAGH, Vinylite VYHH, Vinylite VMCH, Vinylite VYHD, Vinylite VYLF, Vinylite VYNS, Vinylite VMCC, Vinylite VMCA, Vinylite VAGD, Vinylite VERR and Vinylite VROH (trade names, manufactured by Union Carbide Corporation); and DENKA VINYL 1000GKT, DENKA VINYL 1000L, DENKA VINYL 1000 CK, DENKA VINYL 1000A, DENKA VINYL 1000LK2, DENKA VINYL 1000AS, DENKA VINYL 1000MT2, DENKA VINYL 1000CSK, DENKA VINYL 1000CS, DENKA VINYL 1000GK, DENKA VINYL 1000GSK, DENKA VINYL 1000GS, DENKA VINYL 1000LT3, DENKA VINYL 1000D and DENKA VINYL 1000W (trade names, manufactured by Denki Kagaku Kogyo Kabushiki Kaisha).

(Latex Polymer)

In the present invention, other than the aforementioned polymers, latex polymers can also be preferably used. Hereinafter, the latex polymer will be explained.

In the heat-sensitive transfer image-receiving sheet that can be used in the present invention, the latex polymer used in the receptor layer is a dispersion in which hydrophobic polymers comprising a monomer unit of water-insoluble vinyl chloride are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The latex polymer that can be used in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer that can be used in the present invention is preferably −30° C. to 100° C., more preferably 0° C. to 80° C., further more preferably 10° C. to 70° C., and especially preferably 15° C. to 60° C.

In the present invention, as a preferable embodiment of the latex polymer used in the receptor layer, use can be made of polyvinyl chlorides, a copolymer comprising vinyl chloride unit, such as a vinyl chloride-vinyl acetate copolymer and a vinyl chloride-acrylate copolymer. In this case, the vinyl chloride unit in molar ratio is preferably in the range of from 50% to 95%. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to the layer containing the latex, and polymers having excessively large molecular weight bring about poor filming ability. Crosslinkable latex polymers are also preferably used.

The latex polymer that can be used in the present invention is commercially available, and polymers described below may be utilized. Examples thereof include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

These latex polymers may be used singly, or two or more of these polymers may be blended, if necessary.

In the receptor layer, a ratio of the latex polymer comprising a component of vinyl chloride is preferably 50 mass % or more of the whole solid content in the layer.

In the present invention, it is preferable to prepare the receptor layer by applying an aqueous type coating solution and then drying it. The "aqueous type" so-called here means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The latex polymer that can be used in the present invention preferably has a minimum film-forming temperature (MFT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of a latex polymer. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the present invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

The latex polymer that can be used in the present invention may be used (blended) with another latex polymer. Preferable examples of the another latex polymer include polylactates, polyurethanes, polycarbonates, polyesters, polyacetals, and SBR's. Among these, polyesters and polycarbonates are preferable.

In combination with the above-described latex polymer that can be used in the present invention, any polymer can be used. The polymer that can be used in combination is preferably transparent or translucent, and colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. In the coating liquid, a binder may be dissolved or dispersed in an aqueous solvent or in an organic solvent, or may be in the form of an emulsion.

The glass transition temperature (Tg) of the binder that can be used in the present invention is preferably in the range of −30° C. to 70° C., more preferably −10° C. to 50° C., still more preferably 0° C. to 40° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

The polymer used for the binder in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomers are suitably determined considering the type of the monomers to be used. Furthermore, it is preferable to use a dispersant when necessary.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the latex polymer to be used in the present invention, the polymer concentration is, based on the amount of the latex liquid, preferably 10 mass % to 70 mass %, more preferably 20 mass % to 60 mass %, and especially preferably 30 mass % to 55 mass %.

The latex polymer in the image-receiving sheet that can be used in the present invention includes a state of a gel or dried film formed by removing a part of solvents by drying after coating.

[Emulsified Dispersion]

In the present invention, incorporation of an emulsified dispersion (emulsion) in the receptor layer is preferable, especially when the latex polymer is used.

The term "emulsification" as used herein follows the commonly used definition. According to "Kagaku Daijiten (ENCYCLOPEDIA CHIMICA)", Kyoritsu Shuppan Co., Ltd., for example, "emulsification" is defined as "a phenomenon in which, in one liquid, another liquid which does not dissolve in the first liquid are dispersed as fine globules, to form an emulsion". In addition, the term "emulsified dispersion" refers to "a dispersion in which fine globules of one liquid are dispersed in another liquid which does not dissolve the globules". The "emulsified dispersion" preferred in the present invention is "a dispersion of oil globules in water". The content of an emulsified dispersion in the image-receiving sheet that can be used in the present invention is preferably from 0.03 g/m$^2$ to 25.0 g/m$^2$, more preferably from 1.0 g/m$^2$ to 20.0 g/m$^2$.

In the present invention, it is preferable that a high-boiling solvent be included as an oil-soluble substance in the emulsified dispersion. Examples of the high-boiling solvent preferably used include phthalic acid esters (such as dibutyl phthalate, dioctyl phthalate, and di-2-ethyl-hexyl phthalate), phosphoric or phosphonic acid esters (such as triphenyl phosphate, tricresyl phosphate, tri-2-ethylhexyl phosphate), fatty acid esters (such as di-2-ethylhexyl succinate and tributyl citrate), benzoic acid esters (such as 2-ethylhexyl benzoate and dodecylbenzoate), amides (such as N,N-diethyldodecanamide and N,N-dimethyloleinamide), alcohol and phenol compounds (such as isostearyl alcohol and 2,4-di-tert-amylphenol), anilines (such as N,N-dibutyl-2-butoxy-5-tert-octylaniline), chlorinated paraffins, hydrocarbons (such as dodecylbenzene and diisopropylnaphthalene), and carboxylic acids (such as 2-(2,4-di-tert-amylphenoxy)butyric acid), Of these high-boiling solvents, phosphoric or phosphonic acid esters (such as triphenyl phosphate, tricresyl phosphate, and tri-2-ethylhexyl phosphate) are preferred over the others. In addition to such a high-boiling solvent, an organic solvent having a boiling point of 30° C. to 160° C. (such as ethyl acetate, butyl acetate, methyl ethyl ketone, cyclohexanone, methyl cellosolve acetate, or dimethylformamide) may be used as an auxiliary solvent. The content of high-boiling solvent in the emulsified dispersion is preferably from 3.0 to 25% by mass, and more preferably from 5.0 to 20% by mass.

It is preferable that the emulsified dispersion further contain an agent for imparting fastness to images and an ultraviolet absorbent. The compounds preferably used as such agents are any of the compounds represented by formulae (B), (Ph), (E-1) to (E-3), (TS-I) to (TS-VII), (TS-VIIIA), (UA) to (UE) disclosed in JP-A-2004-361936. Further, homopolymers or copolymers insoluble in water and soluble in organic solvents (preferably the compounds disclosed in JP-A-2004-361936, paragraph Nos. 0208 to 0234) may be included therein.

[Plasticizer]

For the purpose of enhancing the sensitivity of the receptor layer, a plasticizer (high boiling organic solvent) may also be added. Examples of such a plasticizer include compounds generally used as plasticizers for vinyl chloride resins, and more specifically monomeric plasticizers such as phthalates, phosphates, adipates and sebacates, and polyester-type plasticizers produced by polymerization of adipic acid or sebacic acid and propylene glycol. Although the former plasticizers are generally low in molecular weight, olefin-type special copolymer resins, which are used as polymeric plasticizer usable for vinyl chloride, may also be used. Examples of resins usable for such a purpose include products marketed under the names of ELVALOY 741, ELVALOY 742, ELVALOY HP443, ELVALOY HP553, ELVALOY EP4015, ELVALOY EP4043, ELVALOY EP4051 (trade names, manufactured by DuPont-Mitsui Polychemicals Co., Ltd.). Such plasticizers can be added to the resins in a proportion of about 100% by mass based on the resin in the receptor layer, but it is appropriate to use them in a proportion of 30% by mass or below in view of bleeding of prints. When the latex polymer is used, it is preferable that those plasticizers be used in a state of the emulsified dispersion as mentioned above.

The receptor layer that can be used in the present invention can be cast by extrusion coating of a melt of the polymer resin as recited above without resorting to solvent coating. The techniques of this extrusion coating are described in *Encyclopedia of Polymer Science and Engineering*, vol. 3, p. 563, John Wiley, New York (1985), and ibid., vol. 6, p. 608 (1986). In addition, the technique for heat-sensitive dye transfer materials is disclosed in JP-A-7-179075, and it is also preferably applicable to the present invention. As the polymer resin, copolymer obtained by condensing cyclohexane dicarboxylate and a 50:50 by mole % mixture of ethylene glycol and bisphenol-A-diethanol (COPOL; registered trade mark) is especially preferred.

[Releasing Agent]

If the image-receiving surface of the heat-sensitive transfer image-receiving sheet lacks a sufficient releasing property, problems of so-called abnormal transfer arises. Examples of the abnormal transfer include a problem that a heat-sensitive transfer sheet and a heat-sensitive transfer image-receiving sheet mutually weld by heat from a thermal head for the image-forming, and thereby a big noise due to peeling arises at the time of peeling; a problem that a dye layer is entirely transferred; and a problem that the receptor layer is peeled from the support. As a method of solving such problems of releasing property, there are known a method of introducing various kinds of releasing agents (lubricant) in the receptor layer and a method of disposing a releasing layer additionally on the receptor layer. In the present invention, it is preferable to use a releasing agent in the receptor layer in order to keep more securely the releasing property between the heat-sensitive transfer sheet and the image-receiving sheet at the time of printing images.

As the releasing agent, solid waxes such as polyethylene wax, amide wax and Teflon (registered trade name) powder; silicone oil, phosphate-series compounds, fluorine-based surfactants, silicone-based surfactants and others including releasing agents known in the technical fields concerned may be used. Among these, fluorine-series compounds typified by fluorine-based surfactants, silicone-based surfactants and silicone-series compounds such as silicone oil and/or its hardened products are preferably used.

As the silicone oil, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into a reaction-curable type, photocurable type, catalyst-curable type, and the like. Among these types, silicone oil that is the reaction-curable type is particularly preferable. As the reaction-curable type silicone oil, products obtained by reacting an amino-modified silicone oil with an epoxy-modified silicone oil and then by curing are preferable. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer. The releasing agent is used preferably in an amount of 2 to 4% by mass and further preferably 2 to 3% by mass based on 100 parts by mass of the polyester resin. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 (trade name, manufactured by Shin-Etsu Chemical Co., Ltd.). Modified silicones represented by any one of the following Formulae 1 to 3 may also be used.

Formula 1

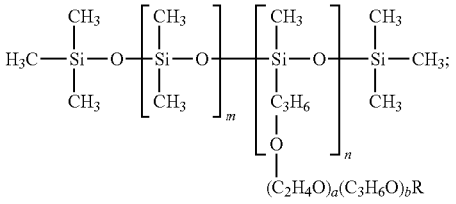

In the Formula 1, R represents a hydrogen atom or a straight-chain or branched alkyl group which may be substituted with an aryl or cycloalkyl group. m and n respectively denote an integer of 2,000 or less, and a and b respectively denote an integer of 30 or less.

Formula 2

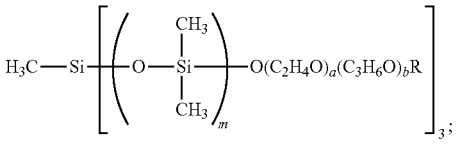

In the Formula 2, R represents a hydrogen atom or a straight-chain or branched alkyl group which may be substituted with an aryl or cycloalkyl group. m denotes an integer of 2,000 or less, and a and b respectively denote an integer of 30 or less.

Formula 3

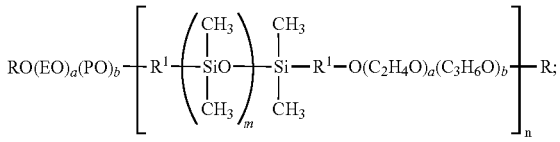

In the Formula 3, R represents a hydrogen atom or a straight-chain or branched alkyl group which may be substituted with an aryl or cycloalkyl group. m and n respectively denote an integer of 2,000 or less, and a and b respectively denote an integer of 30 or less. $R^1$ represents a single bond or a divalent linking group, E represents an ethylene group which may be further substituted, and P represents a propylene group which may be further substituted.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

In some cases, a dye binder is transferred to the receptor layer in a highlight portion of monochrome printing, to cause an irregular transfer. In addition, it is known that an addition polymerization-type silicone generally progresses a hardening reaction in the presence of a catalyst, and that almost all of complexes of transition metal of VIII group, such as Fe group and Pt group, are effective as the hardening catalyst. Among these, a platinum compound has the highest efficiency in general, and a platinum catalyst, which is generally a platinum complex soluble in the silicone oil, is preferably used. Addition amount necessary for the reaction is generally sufficiently about 1 to 100 ppm.

This platinum catalyst has a strong interaction with an organic compound containing an element such as N, P and S, an ionic compound of heavy metal such as Sn, Pb, Hg, Bi and As, or an organic compound containing a polyvalent bond such as an acetylene group. Therefore, if the above-described compounds (catalyst poison) are used together with the platinum catalyst, the ability of the catalyst to hydrosilylate is lost. Resultantly, the platinum catalyst cannot work as the hardening catalyst. Therefore, a problem arises that the platinum catalyst causes silicone to lack in hardening ability, when used with such a catalyst poison (See "Silicone Handbook" published by Nikkan Kogyo Shunbun shya). As a result, such an addition polymerization-type silicone causing such a hardening failure cannot show a releasability needed, when it is used in the receptor layer. As a hardener reacting with an active hydrogen, it is considered to use an isocyanate compound. However, this isocyanate compound and an organic tin compound working as a catalyst to the isocyanate compound act as a catalyst poison to the platinum catalyst. Therefore, the addition polymerization-type silicone has been never used together with the isocyanate compound in the past. Resultantly, the addition polymerization-type silicone has been never used together with a modified silicone having an active hydrogen that shows a releasability needed when hardened with the isocyanate compound.

However, the hardening failure of the addition polymerization-type silicone can be prevented by 1) setting an equivalent amount of the reactive group of the hardener capable of reacting with the active hydrogen, to the reactive group of both the thermoplastic resin and the modified silicone having an active hydrogen, in the range of from 1:1 to 10:1, and 2) setting an addition amount of the platinum catalyst based on the addition polymerization-type silicone in the range of 100 to 10,000 ppm in terms of platinum atom of the platinum catalyst. If the equivalent amount of the reactive group of the hardener capable of reacting with the active hydrogen according to the 1) described above is 1 or less, an amount of silicone having an active hydrogen hardened with an active hydrogen of the thermoplastic resin is so small that an excellent releasability needed cannot be achieved. On the other hand, if the equivalent ratio is 10 or more, a time which is allowed to use an ink in a coating solution for the receptor layer is so short that such the equivalent ratio cannot be substantially applied to the present invention. Beside, if the addition amount of the platinum catalyst according to the 2) described above is 100 ppm or less, activity is lost by the catalyst poison, whereas if the addition amount is 10000 or more, a time which is allowed to use an ink in a coating solution for the receptor layer is so short that such the addition amount cannot be substantially applied to the present invention.

In the present invention, the amount of the receptor layer to be applied is preferably 0.5 to 10 g/m$^2$ (solid basis, hereinafter, the amount to be applied in the present specification is a value on solid basis unless otherwise noted).

<Releasing Layer>

In the case where the hardened modified silicone oil is not added to the receptor layer, the silicone oil may be added to a releasing layer provided on the receptor layer. In this case, the receptor layer may be provided using at least one of the above-described thermoplastic resins. Besides, a receptor layer to which silicone is added may be used. The releasing layer contains a hardened modified silicone oil. A kind of the silicone to be used and a method of using the silicone are the same as for use in the receptor layer. Also, in the case where a catalyst or a retardant is used, the above described descriptions related to addition of these additives to the receptor layer may be applied. The releasing layer may be formed using only a silicone, or alternatively a mixture of a silicone and a binder resin having a good compatibility therewith. A thickness of the releasing layer is generally in the range of about 0.001 to about 1 $g/m^2$.

Examples of the fluorine surfactants include Fluorad FC-430 and FC-431 (trade names manufactured by 3M).

<Undercoat Layer>

An undercoat layer is preferably formed between the receptor layer and the support. As the undercoat layer, for example, at least one of a white background controlling layer, a charge controlling layer, an adhesive layer, or a primer layer is formed. These layers may be formed in the same manner as those described in, for example, each specification of Japanese Patent Nos. 3585599 and 2925244.

(Heat Insulation Layer)

A heat insulation layer serves to protect the support from heat when a thermal head or the like is used to carry out a transfer operation under heating. Also, because the heat insulation layer generally has proper cushion characteristics, a heat-sensitive transfer image-receiving sheet having high printing sensitivity can be obtained even in the case of using paper as a support. The heat insulation layer may be a single layer, or multi-layers. The heat insulation layer is generally arranged at a nearer location to the support than the receptor layer.

In the image-receiving sheet of the present invention, the heat insulation layer preferably contains hollow polymer particles.

The hollow polymer particles in the present invention are polymer particles having independent pores inside of the particles. Examples of the hollow polymer particles include (1) non-foaming type hollow particles obtained in the following manner: a dispersion medium, such as water, is contained inside of a capsule wall formed of a polystyrene, acryl resin, or styrene/acryl resin, and, after a coating solution is applied and dried, the dispersion medium in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The particle size of the hollow polymer particles is preferably 0.1 to 20 μm, more preferably 0.1 to 2 μm, further preferably 0.1 to 1 μm, particularly preferably 0.2 to 0.8 μm. It is because an excessively small size may lead to decrease of the void ratio (hollow ratio) of the particles, prohibiting desirable heat-insulating property, while an excessively large size in relation to the film thickness of the heat insulation layer may result in problems in preparation of smooth surface and cause coating troubles due to the coarse or bulky particles.

The hollow ratio (percentage of hollowness) of the hollow polymer particles is preferably in the range of from about 20% to about 70%, and more preferably from 20% to 50%. If the hollow ratio is less than 20%, it becomes difficult to obtain sufficient heat-insulating property. In contrast, if the hollow ratio is excessively higher, a proportion (rate) of incomplete hollow particles increases in the aforementioned preferable range of the particle size, so that it becomes difficult to obtain sufficient film strength.

The "hollow ratio" of the hollow polymer particles as referred to here is a value P calculated according to the Formula (a), based on the transmission image photographed by a transmission micrograph of hollow particles.

$$P = \left\{ 1/n \times \sum_{i=1}^{n} (Rai/Rbi)^3 \right\} \times 100(\%) \qquad \text{Formula (a)}$$

In formula (a), Rai represents the circle-equivalent diameter of the inner periphery (which shows the periphery of a hollow portion), among two peripheries constituting an image of a specific particle i; Rbi represents the circle-equivalent diameter of the outer periphery (which shows the outer shape of a particle in interest), among the two peripheries constituting the image of the specific particle i; and n is the number of measured particles, and n is generally 300 or more.

The glass transition temperature (Tg) of the hollow polymer particles is preferably 70° C. or higher, more preferably 100° C. or higher. These hollow polymer particles may be used in combinations of two or more of those, according to the need.

Such hollow polymer particles are commercially available. Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461 DE, 551DE, and 551 DE20, manufactured by Nippon Ferrite (all of these product names are trade names). Among these, the hollow polymer particles of the above (1) may be preferably used.

In the heat insulation layer containing the hollow polymer particles, a water-dispersible-type resin or water-soluble-type resin is preferably added, as a binder (binder resin). As the binder resin that can be used in the present invention, use may be made of a known resin, such as an acryl resin, a styrene/acryl copolymer, a polystyrene resin, a polyvinyl alcohol resin, a vinyl acetate resin, an ethylene/vinyl acetate copolymer, a vinyl chloride/vinyl acetate copolymer, a styrene/butadiene copolymer, a polyvinylidene chloride resin, a cellulose derivative, casein, starch, and gelatin. In the present invention, gelatin is particularly preferably used. Also, these resins may be used either singly or as a mixture thereof.

The solid content of the hollow polymer particles in the heat insulation layer preferably falls in a range from 5 to 2,000 parts by mass, more preferably 5 to 1,000 parts by mass, and further preferably 5 to 400 parts by mass, assuming that the solid content of the binder resin be 100 parts by mass. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, and thereby sufficient film strength cannot be obtained, causing deterioration in abrasion resistance.

The heat insulation layer of the heat-sensitive transfer image-receiving sheet that can be used in the present invention is preferably free of any resins that are not resistant to an organic solvent, except for the hollow polymer particles. Incorporation of the resin that is not resistant to an organic solvent (a resin having a dye-dyeing affinity) in the heat insulation layer is not preferable, in view of increase in loss of image definition after image transfer. It is assumed that the color-edge definition loss increases by the reason that owing to the presence of both the resin having a dye-dyeing affinity and the hollow polymer particles in the heat insulation layer, a transferred dye that has dyed the receptor layer migrates through the heat insulation layer adjacent thereto with the lapse of time.

Herein, the term "the resin that is not resistant to an organic solvent" means a resin having a solubility in an organic solvent (e.g., methyl ethyl ketone, ethyl acetate, benzene, toluene, xylene) of generally 0.5 mass % or more, preferably 1 mass % or more. For example, the above-mentioned latex polymer is included in the category of "the resin that is not resistant to an organic solvent".

A thickness of the heat insulation layer containing the hollow polymer particles is preferably from 5 to 50 μm, more preferably from 5 to 40 μm.

A void ratio (porosity ratio) of the heat insulation layer, which is calculated from the thickness of the heat insulation layer containing hollow polymer particles and the solid-matter coating amount of the heat insulation layer including the hollow polymer particles, is preferably 10 to 70% and more preferably 15 to 60%. When the void ratio for the heat-insulation layer is less than 10%, sufficient heat insulation property cannot be obtained. When the void ratio is 70% or more, the binding force among hollow polymer particles deteriorates, and thus sufficient film strength cannot be obtained, and abrasion resistance deteriorates.

The void ratio of the heat insulation layer as referred to herein is a value V calculated according to formula (b) below.

$$V=1\cdot L/L\times\Sigma gi\cdot di \qquad \text{Formula (b)}$$

In formula (b), L represents the thickness of the heat-insulating layer; gi represents the coating amount of a particular material i in terms of solid matter for the heat-insulating layer; and di represents the specific density of the particular material i. When di represents the specific density of the hollow polymer particles, di is the specific density of the wall material of hollow polymer particles.

(Undercoat Layer)

An undercoat layer may be formed between the receptor layer and the heat insulation layer. As the undercoat layer, for example, at least one of a white background controlling layer, a charge controlling layer, an adhesive layer, and a primer layer is formed. These layers may be formed in the same manner as those described in, for example, each specification of Japanese Patent Nos. 3585599 and 2925244.

(Support)

In the present invention, a water-proof support is particularly preferably used as the support. The use of the waterproof support makes it possible to prevent the support from absorbing moisture, whereby a fluctuation in the performance of the receptor layer with lapse of time can be prevented. As the waterproof support, for example, coated paper or laminate paper may be used.

—Coated Paper—

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper and the like. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

—Laminated Paper—

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, use may be made of any antistatic agent including a cationic antistatic agent, such as a quaternary ammonium salt and a polyamine derivative, an anionic antistatic agent, such as an alkyl phosphate, and a nonionic antistatic agent, such as a fatty acid ester. Specifically, the writing layer and the charge control layer may be formed in a manner similar to those described, for example, in the specification of Japanese Patent No. 3585585.

The method of producing the heat-sensitive transfer image-receiving sheet for use in the present invention is explained below.

The heat-sensitive transfer image-receiving sheet for use in the present invention can be preferably formed, by applying at least one receptor layer, at least one intermediate layer and at least one heat-insulation layer, on a support, through simultaneous multi-layer coating.

It is known that in the case of producing an image-receiving sheet composed of plural layers having different functions from each other (for example, an air cell layer, a heat insulation layer, an intermediate layer and a receptor layer) on a support, it may be produced by applying each layer successively one by one, or by overlapping the layers each already coated on a support or substrate, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons Company, 1995, pp. 101-103.

In the present invention, the productivity is greatly improved and, at the same time, image defects can be remarkably reduced, by using the above simultaneous multilayer coating for the production of an image-receiving sheet having a multilayer structure.

The plural layers in the present invention are structured using resins as its major components. Coating solutions forming each layer are preferably water-dispersible latexes. The solid content by mass of the resin put in a latex state in each layer coating solution is preferably in a range from 5 to 80% and particularly preferably 20 to 60%. The average particle size of the resin contained in the above water-dispersed latex is preferably 5 μm or less and particularly preferably 1 μm or less. The above water-dispersed latex may contain a known additive, such as a surfactant, a dispersant, and a binder resin, according to the need.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. Also, in the case where a binder (e.g., a gelatin) to be gelled at lower temperatures is contained, there is the case where it is preferable to drop the temperature immediately after the plural layers are formed on the support.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

According to the present invention, it is possible to provide a heat-sensitive transfer sheet giving an image higher in the maximum density at a high-speed printing and superior in the balance of the yellow, magenta and cyan color densities in the low density region, and an image-forming method, in which an image is transferred by heat using the heat-sensitive transfer sheet.

The present invention will be described in more detail based on the following examples, but the invention is not intended to be limited thereto. In the following examples, the terms "part(s)" and "%" are values by mass, unless otherwise specified.

EXAMPLES

Preparation of Heat Transfer Sheets (Preparation of Heat-Sensitive Transfer Sheet-Coating Liquid and Protective Layer-Coating Liquid)

For preparation of heat-sensitive transfer sheets, the following coating liquids were prepared.

| Preparation of yellow-heat-transfer-layer-coating liquid Y1 | |
|---|---|
| Yellow dye compound Y1-6 | 2.2 mass parts |
| Yellow dye compound Y3-7 | 2.2 mass parts |
| Polyvinylbutyral resin (polymerization degree: 1600) (trade name: S-LEC BH-6, manufactured by Sekisui Chemical Co., Ltd.) | 4.5 mass parts |
| Methyl ethyl ketone/toluene (1/1, at mass ratio) | 90 mass parts |
| **Preparation of magenta-heat-transfer-layer-coating liquid M1** | |
| Magenta dye M2-1 | 1.0 mass part |
| Magenta dye M2-3 | 4.0 mass parts |
| Polyvinylbutyral resin (polymerization degree: 1600) (trade name: S-LEC BH-6, manufactured by Sekisui Chemical Co., Ltd.) | 4.5 mass parts |
| Methyl ethyl ketone/toluene (1/1, at mass ratio) | 90 mass parts |
| **Preparation of cyan-heat-transfer-layer-coating liquid C1** | |
| Cyan dye C1-3 | 0.5 mass part |
| Cyan dye C2-2 | 4.5 mass parts |
| Polyvinylbutyral resin (polymerization degree: 1600) (trade name: S-LEC BH-6, manufactured by Sekisui Chemical Co., Ltd.) | 4.5 mass parts |
| Methyl ethyl ketone/toluene (1/1, at mass ratio) | 90 mass parts |
| **Preparation of heat-transferable protective-layer (releasing layer)-coating liquid** | |
| PUI | |
| Modified cellulose resin (trade name: L-30, manufactured by DAICEL CHEMICAL INDUSTRIES, LTD.) | 5 mass parts |
| Methyl ethyl ketone | 95 mass parts |
| **Preparation of heat-transferable protective-layer (peeling layer)-coating liquid** | |
| PO1 | |
| Acrylic resin solution (Solid content: 40%) (trade name: UNO-1, manufactured by Gifu Ceramics Limited) | 90 mass parts |
| Methanol/isopropanol (1/1, at mass ratio) | 10 mass parts |
| **Preparation of heat-transferable protective-layer (adhesion layer)-coating liquid** | |
| A1 | |
| Acrylic resin (trade name: DIANAL BR-77, manufactured by MITSUBISHI RAYON CO., LTD.) | 25 mass parts |
| The following ultraviolet absorber UV-1 | 1 mass part |
| The following ultraviolet absorber UV-2 | 2 mass parts |
| The following ultraviolet absorber UV-3 | 1 mass part |
| The following ultraviolet absorber UV-4 | 1 mass part |
| PMMA fine particles (polymethyl methacrylate fine particles) | 0.4 mass part |
| Methyl ethyl ketone/toluene (2/1, at mass ratio) | 70 mass parts |

-continued (UV-1)

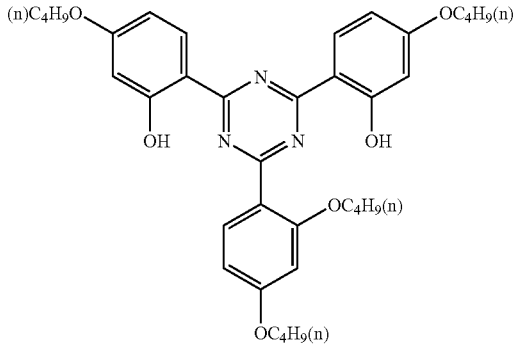

(UV-2)

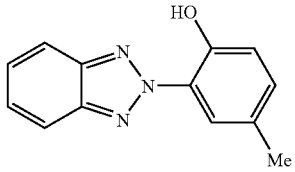

(UV-3)

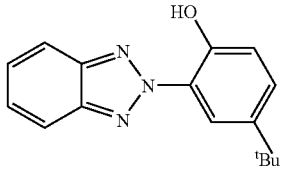

(UV-4)

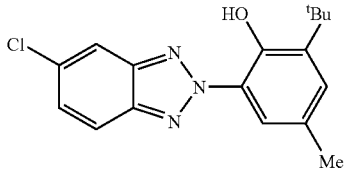

(Preparation of Back Layer-Coating Solution)

In order to prepare a back heat resistance layer of the heat-sensitive transfer sheet, the following coating liquid was prepared.

| Back side layer-coating solution BC1 | |
|---|---|
| Acrylic-series polyol resin (trade name: ACRYDIC A-801, manufactured by Dainippon Ink and Chemicals, Incorporated) | 26.0 mass parts |
| Zinc stearate (trade name: SZ-2000, manufactured by Sakai Chemical Industry Co., Ltd.) | 0.43 mass part |
| Phosphate (trade name: PLYSURF A217, manufactured by Dai-ichi Kogyo Seiyaku Co., Ltd.) | 1.27 mass parts |
| Isocyanate (50% solution) (trade name: BURNOCK D-800, manufactured by Dainippon Ink and Chemicals, Incorporated) | 8.0 mass parts |
| Methyl ethyl ketone/toluene (2/1, at mass ratio) | 64 mass parts |

(Preparation of Sheets by Coating of Coating Liquids Described Above)

A polyester film 6.0 μm in thickness (trade name: Diafoil K200E-6F, manufactured by MITSUBISHI POLYESTER FILM CORPORATION), that was subjected to an adhesion-treatment on one surface of the film, was used as a support. The following back side-layer coating solution was applied onto the support on the other surface that was not subjected to the adhesion-treatment, so that the coating amount based on the solid content after drying would be 1 g/m$^2$. After drying, the coated film was hardened by heat at 60° C.

A heat-sensitive transfer sheet A was prepared by coating the above-described coating liquids on the surface that was subjected to the adhesion-treatment of the thus-prepared polyethylene film so that a yellow heat-sensitive transfer layer, a magenta heat-sensitive transfer layer, a cyan heat-sensitive transfer layer, and a protective layer could be disposed in area order in the longitudinal direction of the polyester film. In the case of forming a protective layer, the protective layer (releasing layer)-coating liquid PU1 was coated and dried, and then the protective layer (peeling layer)-coating liquid PO1 was coated on the releasing layer and dried, and then the protective layer (adhesion layer)-coating liquid A1 was coated on the peeling layer.

A coating amount of each layers applied in this preparation was controlled so that the solid content coating amount would become the value set forth below.

| | |
|---|---|
| Yellow heat-transfer layer | 0.9 g/m$^2$ |
| Magenta heat-transfer layer | 0.8 g/m$^2$ |
| Cyan heat-transfer layer | 1.0 g/m$^2$ |
| Protective releasing layer | 0.3 g/m$^2$ |

Polyvinylbutyral resin (polymerization degree: 800) (trade name: DENKA BUTYRAL #3000-K, manufactured by DENKI KAGAKU KOGYOU K. K.)

Polyvinylacetoacetal resin (polymerization degree: 2000) (trade name: S-LEC KS-3, manufactured by Sekisui Chemical Co., Ltd.)

Polyvinylacetoacetal resin (polymerization degree: 500) (trade name: S-LEC KS-1, manufactured by Sekisui Chemical Co., Ltd.)

Polyvinylacetoacetal resin (polymerization degree: 300) (trade name: S-LEC KS-10, manufactured by Sekisui Chemical Co., Ltd.)

In Table 1, the polyvinylbutyral resin was designated as PBB, and the polyvinyl acetacetal resin, as PBA. When multiple resins were used for the same transfer layer, the content of each resin was expressed by mass % with respect to the total resin content in each transfer layer, while making the total resin content identical with that in the heat-sensitive transfer sheet A, while, when multiple dyes were used for the same transfer layer, the rate of each dye was expressed by mass % with respect to the total dye mass in each transfer layer, while making the total dye mass identical with that in the heat-sensitive transfer sheet A.

TABLE 1

| | Yellow-heat-transfer-layer | | | | | Magenta-heat-transfer-layer | | | | | Cyan-heat-transfer-layer | | | | | |
|---|---|---|---|---|---|---|---|---|---|---|---|---|---|---|---|---|
| | Resin | | | Dye | | Resin | | | Dye | | Resin | | | Dye | | |
| Sample | Kind | PD* | Ratio | Name | Ratio | Kind | PD* | Ratio | Name | Ratio | Kind | PD* | Ratio | Name | Ratio | Remarks |
| A | PBB | 1700 | 100 | Y1-6 | 50 | PBB | 1700 | 100 | M2-1 | 20 | PBB | 1700 | 100 | C1-3 | 10 | Comparative |
| | | | | Y3-7 | 50 | | | | M2-3 | 80 | | | | C2-2 | 90 | example |
| B | PBA | 2000 | 100 | Y1-6 | 50 | PBA | 2000 | 100 | M2-1 | 20 | PBA | 2000 | 100 | C1-3 | 10 | Comparative |
| | | | | Y3-7 | 50 | | | | M2-3 | 80 | | | | C2-2 | 90 | example |
| C | PBB | 1700 | 40 | Y1-6 | 50 | PBA | 2000 | 100 | M2-1 | 20 | PBB | 1700 | 15 | C1-3 | 10 | Comparative |
| | PBA | 2000 | 60 | Y3-7 | 50 | | | | M2-3 | 80 | PBA | 2000 | 85 | C2-2 | 90 | example |
| D | PBB | 600 | 100 | Y1-6 | 50 | PBB | 600 | 100 | M2-1 | 20 | PBB | 600 | 100 | C1-3 | 10 | Comparative |
| | | | | Y3-7 | 50 | | | | M2-3 | 80 | | | | C2-2 | 90 | example |
| E | PBA | 500 | 100 | Y1-6 | 50 | PBA | 500 | 100 | M2-1 | 20 | PBA | 500 | 100 | C1-3 | 10 | Comparative |
| | | | | Y3-7 | 50 | | | | M2-3 | 80 | | | | C2-2 | 90 | example |
| F | PBB | 600 | 40 | Y1-6 | 50 | PBB | 600 | 40 | M2-1 | 20 | PBB | 600 | 40 | C1-3 | 10 | Comparative |
| | PBA | 500 | 60 | Y3-7 | 50 | PBA | 500 | 60 | M2-3 | 80 | PBA | 500 | 60 | C2-2 | 90 | example |
| G | PBB | 600 | 40 | Y1-6 | 100 | PBB | 600 | 40 | M2-1 | 100 | PBB | 600 | 40 | C1-3 | 100 | Comparative |
| | PBA | 500 | 60 | | | PBA | 500 | 60 | | | PBA | 500 | 60 | | | example |
| H | PBB | 600 | 40 | Y3-7 | 100 | PBB | 600 | 40 | M2-3 | 100 | PBB | 600 | 40 | C2-2 | 100 | Comparative |
| | PBA | 500 | 60 | | | PBA | 500 | 60 | | | PBA | 500 | 60 | | | example |
| I | PBB | 600 | 40 | Y1-6 | 50 | PBA | 500 | 100 | M2-1 | 20 | PBA | 500 | 100 | C1-3 | 10 | This invention |
| | PBA | 500 | 60 | Y3-7 | 50 | | | | M2-3 | 80 | | | | C2-2 | 90 | |
| J | PBB | 600 | 40 | Y1-6 | 50 | PBA | 500 | 100 | M2-1 | 20 | PBB | 600 | 15 | C1-3 | 10 | This invention |
| | PBA | 500 | 60 | Y3-7 | 50 | | | | M2-3 | 80 | PBA | 500 | 85 | C2-2 | 90 | |
| K | PBB | 800 | 40 | Y1-6 | 50 | PBA | 300 | 100 | M2-1 | 20 | PBB | 800 | 15 | C1-3 | 10 | This invention |
| | PBA | 300 | 60 | Y3-7 | 50 | | | | M2-3 | 80 | PBA | 300 | 85 | C2-2 | 90 | |

*"PD" means polymerization degree.

-continued

| | |
|---|---|
| Protective peeling layer | 0.5 g/m$^2$ |
| Protective adhesive layer | 2.0 g/m$^2$ |

Heat-sensitive transfer sheets B to K were prepared similarly to the heat-sensitive transfer sheet A, except that the resins and dyes for the heat-sensitive transfer layers in respective colors were changed as shown in Table 1. The resins used in Table 1 include the followings, in addition to the polyvinylbutyral resin (polymerization degree; 1600) (trade name: S-LEC BH-6, manufactured by Sekisui Chemical Co., Ltd.). Polyvinylbutyral resin (polymerization degree: 600) (trade name: DENKA BUTYRAL #3000-C, manufactured by DENKI KAGAKU KOGYOU K. K.)

[Preparation of Heat Sensitive Image-Receiving Sheet]

Preparation of Image-Receiving Sheet

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer, and the upper receptor layer after drying would be 6.7 g/m$^2$, 8.6 g/m$^2$, 2.6 g/m$^2$ and 2.7 g/m$^2$, respectively.

| | |
|---|---|
| Upper receptor layer | |
| Vinyl chloride-series latex (as a solid content) (trade name: Vinybran 900, manufactured by Nisshin Chemicals Co., Ltd.) | 22.2 mass parts |
| Vinyl chloride-series latex (as a solid content) (trade name: Vinybran 276, manufactured by Nisshin Chemicals Co., Ltd.) | 2.5 mass parts |
| Gelatin | 0.4 mass part |
| The following ester-series wax EW-1 | 2.2 mass parts |
| The following surfactant F-1 | 0.04 mass part |
| Lower receptor layer | |
| Vinyl chloride-series latex (as a solid content) (trade name: Vinybran 690, manufactured by Nisshin Chemicals Co., Ltd.) | 24.4 mass parts |
| Gelatin | 1.6 mass parts |
| The following surfactant F-1 | 0.04 mass part |
| Heat insulation layer | |
| Hollow latex polymer particles (as a solid content) (trade name: MH5055, manufactured by Nippon Zeon Co., Ltd.) | 580 mass parts |
| Gelatin | 270 mass parts |
| Subbing layer | |
| Polyvinyl alcohol (trade name: POVAL PVA 205, manufactured by Kuraray) | 17.2 mass parts |
| Styrene butadiene rubber latex (as a solid content) (trade name: SN-307, manufactured by NIPPON A & L INC) | 150 mass parts |
| The following surfactant F-1 | 0.1 mass part |

(EW-1)

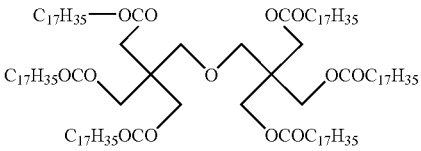

(F-1)

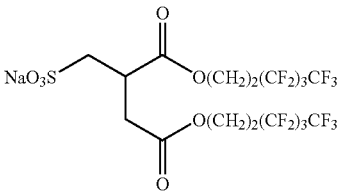

[Image Formation 1]

Image transfer was performed by using each of the heat-sensitive transfer sheets A to K and the heat-sensitive transfer image-receiving sheet S, superposing the heat-sensitive transfer sheet on the heat-sensitive transfer image-receiving sheet with the heat-sensitive transfer layer being in contact with the image-receiving layer, and heating the heat-sensitive transfer image-receiving sheet from the support side by a thermal head. As for the order of the heat-sensitive transfer, an yellow image was first transferred by overlapping the region corresponding to the yellow heat-sensitive transfer layer of the heat-sensitive transfer layer on an image-receiving sheet, heating the region with a thermal head, and then, peeling off the heat-sensitive transfer sheet from the image-receiving sheet; an magenta image was secondly transferred by overlapping the magenta heat-sensitive transfer layer on the image-receiving sheet, heating the region with a thermal head, and peeling off the heat-sensitive transfer sheet from the image-receiving paper; an cyan image was thirdly transferred by overlapping the cyan heat-sensitive transfer layer on the image-receiving sheet, heating the region with a thermal head, and peeling off the heat-sensitive transfer sheet from the image-receiving sheet; and a protective layer itself was fourthly transferred onto the heat-sensitive image-receiving sheet by overlapping the protective layer on the image-receiving sheet, heating the layer with a thermal head, and peeling off the heat-sensitive transfer sheet from the image-receiving sheet, to give a print carrying a formed color image. The thermal head used was a line head at 300 dpi (300 dots per 25.4 mm), and the printing was performed at a printing speed of 120 mm/second and a maximum heat quantity of 300 mJ/dot. The original data for the image data included R, G and B data respectively of 8 bit (256-stage digital data of integers of 0 to 255) corresponded to each pixel, and the heat quantity of the thermal head was controlled for each pixel, based on the data, for production of an image in varying density. The R data corresponded to the cyan image; the G data corresponded to the magenta; the B data corresponded to the yellow image; and 0 in the 8 bit data corresponded to the maximum transfer density, while 255 corresponded to the untransferred white region.

An original image, for one screen, having a region corresponding to the maximum density at a (R, G, B) of (0, 0, 0), a region corresponding to the low-density region at (110, 110, 110), and a region corresponding to the untransferred white region at (255, 255, 255) was used in forming a print.

[Evaluation Test 1]

The reflection density in the maximum density region, the low-density region and the white region of the print sample obtained was determined by using Xrite 310 (trade name, manufactured by Xrite), and the densities of yellow (Y), magenta (M), and cyan (C) were determined and designated as Y density, M density and C density. For evaluation of the storage property of the heat-sensitive transfer sheets, the various heat-sensitive transfer sheets were stored at 50° C. and humidity of 40% for 14 days, and, after the image formation above, the reflection density in the white region was determined. When each density in the maximum density region is higher, the density of the image is higher. Determined was a value corresponding to the difference in color from neutral gray in the low-density region, which is represented by the following Formula.

$$[\{(M\text{ Density})-(Y\text{ Density})\}^2+\{(M\text{ Density})-(C\text{ Density})\}^2]^{1/2}$$

A smaller value means that the color balance is more favorable. A lower density in the white region means that the region is whiter.

Results are summarized in Table 2.

TABLE 2

| | Maximum density | | | Low density | | | | White region | | | White region (Transfer sheet after storage was used.) | | | |
|---|---|---|---|---|---|---|---|---|---|---|---|---|---|---|
| Sample | Y density | M density | C density | Y density | M density | C density | Difference in color | Y density | M density | C density | Y density | M density | C density | Remarks |
| A | 2.05 | 1.92 | 1.91 | 0.71 | 0.69 | 0.51 | 0.18 | 0.04 | 0.07 | 0.05 | 0.10 | 0.09 | 0.16 | Comparative example |
| B | 1.85 | 1.72 | 1.86 | 0.68 | 0.70 | 0.43 | 0.27 | 0.04 | 0.07 | 0.06 | 0.04 | 0.06 | 0.06 | Comparative example |
| C | 1.82 | 1.86 | 1.85 | 0.70 | 0.69 | 0.52 | 0.17 | 0.04 | 0.07 | 0.05 | 0.04 | 0.06 | 0.07 | Comparative example |
| D | 1.90 | 2.01 | 1.83 | 0.92 | 0.77 | 0.86 | 0.17 | 0.07 | 0.07 | 0.10 | 0.14 | 0.10 | 0.21 | Comparative example |
| E | 2.09 | 2.06 | 2.05 | 0.59 | 0.74 | 0.70 | 0.16 | 0.04 | 0.07 | 0.06 | 0.04 | 0.07 | 0.06 | Comparative example |
| F | 2.11 | 2.03 | 1.98 | 0.90 | 0.76 | 0.83 | 0.16 | 0.04 | 0.07 | 0.06 | 0.05 | 0.07 | 0.04 | Comparative example |
| G | 1.88 | 1.65 | 1.45 | 0.68 | 0.62 | 0.51 | 0.13 | 0.05 | 0.07 | 0.06 | 0.12 | 0.16 | 0.18 | Comparative example |
| H | 1.56 | 1.87 | 1.90 | 0.60 | 0.68 | 0.79 | 0.14 | 0.05 | 0.07 | 0.06 | 0.14 | 0.12 | 0.14 | Comparative example |
| I | 2.11 | 2.18 | 2.01 | 0.73 | 0.75 | 0.69 | 0.06 | 0.04 | 0.07 | 0.06 | 0.04 | 0.06 | 0.06 | This invention |
| J | 2.13 | 2.15 | 2.00 | 0.73 | 0.76 | 0.74 | 0.04 | 0.05 | 0.06 | 0.05 | 0.05 | 0.07 | 0.06 | This invention |
| K | 2.06 | 2.15 | 2.03 | 0.72 | 0.76 | 0.74 | 0.04 | 0.05 | 0.07 | 0.05 | 0.05 | 0.06 | 0.05 | This invention |

As obvious from the results of the samples A, B and C in Table 2, combined use of a polyvinylbutyral having a polymerization degree of 1,500 or more and a polyvinyl acetacetal having a polymerization degree of 1,500 or more, as described in JP-A-4-148990, improved the storage property of the heat-sensitive transfer sheet and suppressed increase in density in the white region even when the transfer sheet after storage was used. However, evaluation during high-speed printing showed insufficient maximum density and also drastic deterioration of the color balance in the low density area.

As obvious from the samples D, E and F in Table 2, combined use of a polyvinylbutyral having a polymerization degree 1,000 or less and a polyvinyl acetacetal having a polymerization degree of 1,000 or less improved the maximum density and also the storage property of the heat-sensitive transfer sheet similarly and suppressed the increase in density in the white region even when a transfer sheet after storage was used. However, the color balance in the low density region was not favorably controlled.

As obvious from the results of the samples F, G and H in Table 2, compared to use of one kind of a dye in each heat-sensitive transfer layer, combined use of multiple dyes raised the maximum density and improved the storage property of the heat-sensitive transfer sheet and also the density in the white region when a transfer sheet after storage was used, showing the advantageous effects of combined use of multiple resins and multiple colorants described in JP-A-6-286335. However, the color balance in the low-density region rather deteriorated at the same time.

Comparison of the samples I, J and K with other samples in Table 2 reveals that the samples according to the present invention were superior in the maximum density, resistant to the increase in density in the white region when a transfer sheet after storage was used, and also superior in the color balance in the low density region.

Only transfer layers containing only one kind of a dye are described in the Examples of JP-A-4-148990 and JP-A-6-286335, and the color balance, an advantageous effect of the present invention, was not disclosed at all therein.

Subsequently, for examination of the influence on color balance by using an actual figure, evaluation was performed, while the original data for use in the [Image formation 1] and the [Evaluation test 1] were changed in the following manner by using the samples C, F, I and J.

[Image Formation 2]

An image of female portrait taken by a digital camera (trade name: FinePix Z1, manufactured by FUJIFILM CORPORATION) was used as the original image for one screen and converted into 8-bit (R, G, and B) data, and the print was prepared in a similar manner to the [Image formation 1] described above except that the image was heat-sensitively transferred onto a KG-sized recording medium.

[Evaluation Test 2]

The print sample obtained was examined by visual observation, and the color of the female portrait image was evaluated according to the following criteria. In ranks of C and D, the evaluation was made, with the reason for unacceptability described.

| | |
|---|---|
| (Rank A) | Color reproduction in female portrait was very favorable. |
| (Rank B) | Color reproduction in female portrait was favorable or allowable. |
| (Rank C) | Color in the female portrait was slightly peculiar and unacceptable. |
| (Rank D) | Color in the female portrait was distinctly peculiar and unacceptable. |

Results are summarized in Table 3.

TABLE 3

| Sample | Ranking | Reason for unacceptability | Remarks |
|---|---|---|---|
| C | D | The entire face was reddish, the shade of the face was shallow, and the portrait is not well defined. | Comparative example |
| F | D | The face was bluish and the shade of the face was greenish. | Comparative example |

TABLE 3-continued

| Sample | Ranking | Reason for unacceptability | Remarks |
|---|---|---|---|
| I | B | None | This invention |
| J | A | None | This invention |

The results in Table 3 demonstrate distinctively the advantageous effects of the present invention on color reproduction in the actual female portrait image.

Subsequently, for examination of the effects during low speed printing, evaluation was performed in a similar manner to [Evaluation test 1], except that the printing condition used in [Image formation 1] was changed to the following condition while the samples C, F, I and J were used.

[Image Formation 3]

A print was prepared in a similar manner to [Image formation 1], except for a printing speed of 40 mm/second and a maximum heat quantity of 100 mJ/dot.

Results are summarized in Table 4.

TABLE 4

| | Maximum density | | | Low density | | | | White region | | | White region (Transfer sheet after storage was used.) | | | |
|---|---|---|---|---|---|---|---|---|---|---|---|---|---|---|
| Sample | Y density | M density | C density | Y density | M density | C density | Difference in color | Y density | M density | C density | Y density | M density | C density | Remarks |
| C | 2.03 | 2.00 | 2.02 | 0.67 | 0.70 | 0.61 | 0.09 | 0.04 | 0.07 | 0.05 | 0.05 | 0.06 | 0.05 | Comparative example |
| F | 2.08 | 2.10 | 2.03 | 0.68 | 0.73 | 0.65 | 0.09 | 0.04 | 0.07 | 0.06 | 0.04 | 0.07 | 0.05 | Comparative example |
| I | 2.05 | 2.08 | 2.01 | 0.70 | 0.69 | 0.67 | 0.02 | 0.04 | 0.07 | 0.05 | 0.04 | 0.06 | 0.06 | This invention |
| J | 2.02 | 2.10 | 2.06 | 0.69 | 0.71 | 0.69 | 0.03 | 0.05 | 0.07 | 0.05 | 0.05 | 0.06 | 0.06 | This invention |

The results in Table 4 show that the samples according to the present invention were better in color balance in the low-density region than the samples in Comparative Examples.

In addition, comparison of the results in Tables 2 and 4 shows that the sample C of Comparative Example and the sample J had a higher maximum density and better color balance in the low density region when printed in a low speed printer.

Thus, using the samples in Comparative Examples at a high-speed printing lead to deterioration in maximum density and also to significant deterioration in the color balance in the low-density region. On the contrary, it is shown that the samples according to the present invention do not cause deterioration in the properties above and give a high-quality print even during high-speed printing.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer sheet, comprising a base film, at least three heat-sensitive transfer layers containing heat-sensitively transferable dyes and a resin formed on one face of the base film, and a heat-resistant slipping layer formed on the other face of the base film, wherein each of the at least three heat-sensitive transfer layers contains two or more kinds of dyes different from each other, wherein the at least three heat-sensitive transfer layers are provided on one face of the base film so as not to be superposed on one another, wherein the at least three heat-sensitive transfer layers each contains, as the resin, at least one selected from the group consisting of a polyvinylbutyral resin having a polymerization degree of 200 to 1,000 and a polyvinyl acetacetal resin having a polymerization degree of 200 to 1,000, and wherein at least one of the at least three heat-sensitive transfer layers contains both the polyvinylbutyral resin as described above and the polyvinyl acetacetal resin described above, and has a ratio of the polyvinylbutyral to the polyvinyl acetacetal different from that of any other of the at least three heat-sensitive transfer layers containing both the polyvinylbutyral resin as described above and the polyvinyl acetacetal resin described above.

2. The heat-sensitive transfer sheet according to claim 1, wherein content of each of the two or more kinds of dyes (mass %) is 90 mass % or less with respect to the total amount of dyes in each of the heat-sensitive transfer layers.

3. The heat-sensitive transfer sheet according to claim 2, wherein the at least three heat-sensitive transfer layers include a heat-sensitive transfer layer allowing transfer of yellow image, a heat-sensitive transfer layer allowing transfer of magenta image, and a heat-sensitive transfer layer allowing transfer of cyan image.

4. The heat-sensitive transfer sheet according to claim 1, wherein the at least three heat-sensitive transfer layers include a heat-sensitive transfer layer allowing transfer of yellow image, a heat-sensitive transfer layer allowing transfer of magenta image, and a heat-sensitive transfer layer allowing transfer of cyan image.

5. An image-forming method, comprising the steps of:

superposing a heat-sensitive transfer sheet on a heat-sensitive transfer image-receiving sheet; and providing thermal energy from a side of a heat-resistant slipping layer as described below of the heat-sensitive transfer sheet with a thermal head, thereby to transfer dyes contained in heat-sensitive transfer layers of the heat-sensitive transfer sheet onto the heat-sensitive transfer image-receiving sheet, and print an image;

wherein the heat-sensitive transfer sheet comprises a base film, at least three heat-sensitive transfer layers containing heat-sensitively transferable dyes and a resin formed on one face of the base film, and the heat-resistant slipping layer formed on the other face of the base film, wherein each of the at least three heat-sensitive transfer layers contains two or more kinds of dyes different from each other, wherein the at least three heat-sensitive transfer layers are provided on one face of the base film so as not to be superposed on one another, wherein the at least three heat-sensitive transfer layers each contains, as the resin, at least one selected from the group consisting of a polyvinylbutyral resin having a polymerization degree of 200 to 1,000 and a polyvinyl acetacetal resin having a polymerization degree of 200 to 1,000, wherein at least one of the at least three heat-sensitive transfer layers contains both the polyvinylbutyral resin as described above and the polyvinyl acetacetal resin described above, and has a ratio of the polyvinylbutyral to the polyvinyl acetacetal different from that of any other of the at least three heat-sensitive transfer layers containing both the polyvinylbutyral resin as described above and the polyvinyl acetacetal resin described above, and wherein each of the heat-sensitive transfer layers is printed with the thermal head at a speed of 100 mm/second or more.

6. The image-forming method according to claim 5, wherein content of each of the two or more kinds of dyes (mass %) is 90 mass % or less with respect to the total amount of dyes in each of the heat-sensitive transfer layers.

7. The image-forming method according to claim 6, wherein the at least three heat-sensitive transfer layers include a heat-sensitive transfer layer allowing transfer of yellow image, a heat-sensitive transfer layer allowing transfer of magenta image, and a heat-sensitive transfer layer allowing transfer of cyan image.

8. The image-forming method according to claim 5, wherein the at least three heat-sensitive transfer layers include a heat-sensitive transfer layer allowing transfer of yellow image, a heat-sensitive transfer layer allowing transfer of magenta image, and a heat-sensitive transfer layer allowing transfer of cyan image.

* * * * *